United States Patent [19]

Suzuki et al.

[11] Patent Number: 4,907,484

[45] Date of Patent: Mar. 13, 1990

[54] TONE SIGNAL PROCESSING DEVICE USING A DIGITAL FILTER

[75] Inventors: Hideo Suzuki; Yoshio Fujita; Hirotaka Kuribayashi, all of Hamamatsu, Japan

[73] Assignee: Yamaha Corporation, Hamamatsu, Japan

[21] Appl. No.: 115,772

[22] Filed: Oct. 30, 1987

[30] Foreign Application Priority Data

Nov. 2, 1986 [JP] Japan ..... 61-261192
May 22, 1987 [JP] Japan ..... 62-125560
May 22, 1987 [JP] Japan ..... 62-125561

[51] Int. Cl.[4] ..... G10H 1/12; G10H 7/00

[52] U.S. Cl. ..... 84/661; 84/DIG. 9; 84/622; 84/629; 84/663; 364/724.1; 381/51

[58] Field of Search ..... 84/1.19–1.23, 84/1.13, 1.26, 1.1, DIG. 9; 364/724, 419; 381/41, 51

[56] References Cited

U.S. PATENT DOCUMENTS 4,184,402 1/1980 Kugisawa ..... 84/1.24 X
4,416,179 11/1983 Wachi ..... 84/1.19
4,554,858 11/1985 Wachi et al. ..... 381/51 X
4,638,709 1/1987 Nagashima et al. ..... 84/1.19
4,677,889 7/1987 Deutsch ..... 84/1.23 X
4,715,257 12/1987 Hoshiai et al. ..... 84/1.01
4,738,179 4/1988 Hideo ..... 84/1.19
4,779,505 10/1988 Suzuki ..... 84/1.22
4,829,463 5/1989 Kakishita et al. ..... 84/1.19 X

FOREIGN PATENT DOCUMENTS 140008 8/1985 European Pat. Off. .

*Primary Examiner*—Stanley J. Witkowski
*Attorney, Agent, or Firm*—Spensley Horn Jubas & Lubitz

[57] ABSTRACT

At least two sets of filter coefficients corresponding to different filter characteristics are interpolated by using a control signal for controlling tone color as a parameter of interpolation. Filter coefficients obtained by the interpolation are supplied to a digital filter to determine its filter characteristics and an input tone signal is modified in accordance with the filter characteristics thus determined. Filter characteristics of diverse variation as compared with the number of prepared filter coefficients can thereby be realized. Further, timewise change of filter characteristics can be realized by changing a parameter of interpolation with lapse of time or changing two sets of filter coefficients to be interpolated with lapse of time. Designation of filter coefficients can be made by designating coordinate data of coordinates having at least two axes. In this case, filter coefficients can be changed by changing coordinate data of at least one axis in accordance with tone color control information whereby filter characteristics can be variably controlled.

28 Claims, 12 Drawing Sheets

DIGITAL FILTER 23

FILTER COEFFICIENT TABLE

DISPLAY 230

| | | | |
|---|---|---|---|
| Filter edit menu: | | Select 1 – 4 | |
| 1. Parameter | 2. Envelope | 3. Lfo | 4. Scale |

| | | | | |
|---|---|---|---|---|
| Filter 1 : | tb1 | Dyn-axis | dyn | fix |
| Parameter: | 12 | x-axis | 15 | 12 |

| | | | | | | | | |
|---|---|---|---|---|---|---|---|---|
| Filter2: | R1 | R2 | R3 | R4 | L1 | L2 | L3 | L4 |
| Envelope : | 99 | 99 | 99 | 99 | 99 | 99 | 99 | 99 |

| | | | | |
|---|---|---|---|---|
| Filter3: | wave | speed | delay | depth |
| LFO: | sin | 99 | 99 | 99 |

| | |
|---|---|
| Filter4: | Curve Select |
| Key Scaling: | 12 |

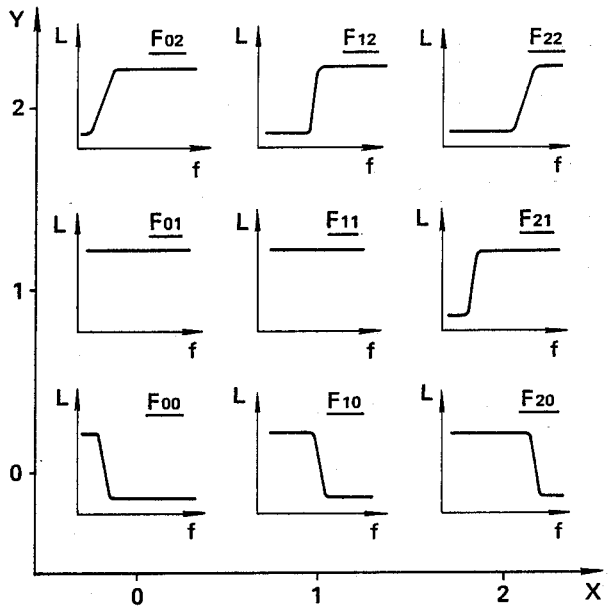

FIG. 13

DATA AND WORKING RAM 113

| | |
|---|---|
| KCODE | KEY CODE |
| TDATA | TOUCH DATA |
| WHEELD | MODULATION WHEEL DATA |
| FTABLE | FILTER COEF. TABLE |
| DYNAXS | DYNAMIC AXIS |
| DYN | DYN. AXS. REF. COORD. |
| FIX | FIXED AXIS COORD. |
| FENV (0) | FILTER |
| FENV (1) | ENVELOPE |
| FENV (2) | DETERMINING |
| ⋮ | DATA |
| FENV (7) | |
| WAVE | LOW FREQ. |
| SPEED | MODULATION |
| DELAY | SIGNAL |
| DEPTH | DETERMINING DATA |

| | |
|---|---|
| KYSCV | KEY SCALING CURVE SELECT |
| EGDATA | PRESENT ENV. |
| LFODAT | PRESENT LFMS. |
| KYSDAT | KEY SCALING |
| DYNDAT | DYN. AXS. COORD. |
| XAXIS | X–AXIS COORD. |
| YAXIS | Y–AXIS COORD. |
| COEFA | INTERPOLATION |
| COEFB | OPE. COEF. REG. |
| COEFD (0) | FILTER |
| COEFD (1) | COEFFICIENT |
| COEFD (2) | REGISTERS |
| ⋮ | |
| COEFD (31) | |

FIG. 14

TONE SIGNAL PROCESSING DEVICE USING A DIGITAL FILTER

BACKGROUND OF THE INVENTION

This invention relates to a tone signal processing device using a digital filter and, more particularly, to realizing rich filter characteristics by preparing filter coefficients by interpolation and further to realizing timewise change of tone color by variably controlling filter characteristics with lapse of time and, still further, to controlling selective supply of filter coefficients in accordance with tone color control information.

An electronic musical instrument realizing timewise change of tone color by timewise changing filter coefficients of a digital filter for controlling a tone signal is disclosed in European Patent Application Publication No. 140,008. In this electronic musical instrument, filter coefficients are stored in a memory in correspondence to a predetermined time frame, filter coefficients corresponding to each time frame are read out from the memory at each time frame and applied to the digital filter whereby filter characteristics are changed frame by frame by changing the filter coefficients frame by frame.

In a case where filter characteristics are to be variably controlled in order to realize tone color control in response to tone color information including key touch and key scaling, filter characteristics have to be prestored in a memory for each realizable filter characteristic.

In the prior art technique in which filter coefficients do not change during one time frame, tone color change is not obtainable when one time frame is relatively long with resulting monotonousness in the tone color. Besides, the tone color change tends to become unnatural due to abrupt change in filter coefficients when the time frame changes. Such problems can be overcome if the time length of one time frame is shortened. This however leads to another problem in that it requires a filter coefficient memory of increased capacity.

Further, in a case where tone color control is to be performed in accordance with tone color control information including key touch and key scaling, if rich tone color change control is desired, multiple sets of filter coefficients must be prestored in a memory and so the capacity of the filter coefficient memory must be increased.

In the filter coefficient memory of the prior art technique, addresses are simply assigned to respective sets of filter coefficients stored therein and one set of filter coefficients is read out from an address corresponding to the tone color control information.

In this type of filter coefficient selection system, however, the relation between address storing filter coefficients and tone color information is a fixed one-to-one relation so that a degree of freedom in the tone color change control is scarce.

SUMMARY OF THE INVENTION

It is, therefore, an object of the invention to provide a tone signal processing device capable of realizing rich filter characteristics without increasing the amount of prepared filter coefficients and thereby realizing rich tone color change control.

It is another object of the invention to provide a tone signal processing device capable of supplying filter coefficients which change smoothly at a relatively fine time interval without increasing the amount of prepared filter coefficients and thereby realizing smooth tone color change.

It is still another object of the invention to provide a tone signal processing device capable of performing selection of filter coefficients in rich variety.

For achieving these objects of the invention, a tone signal processing device according to the invention comprises a digital filter means receiving a tone signal and filter coefficients for controlling the input tone signal in accordance with characteristics determined by the filter coefficients, filter coefficient supply means for supplying at least two sets of filter coefficients corresponding to different filter characteristics, control signal generation means for generating a control signal for controlling tone color, and filter coefficient interpolation means for interpolating at least two sets of filter coefficients supplied by the filter coefficient supply means using the control signal generated by the control signal generation means and supplying filter coefficients obtained by the interpolation to the digital filter means.

The control signal generated by the control signal generation means may be tone color control information based on any tone color control elements such as lapse of time, key touch, tone pitch or tone range, output of manual operator, envelope shape data and low frequency modulating signal.

At least two sets of filter coefficients corresponding to different filter characteristics are respectively supplied by the filter coefficient supply means. The filter coefficient interpolation means interpolates the at least two sets of filter coefficients supplied by the filter coefficient supply means using the control signal generated by the control signal generation means as a parameter of interpolation and supplies filter coefficients obtained by the interpolation to the digital filter means.

Since fine filter coefficients corresponding to contents of the tone color control can be produced by the interpolation, rich filter characteristics can be realized and a rich tone color change control can thereby be realized without increasing the amount of prepared filter coefficients.

In a case where, for example, timewise change of tone color is to be realized by changing filter characteristics with lapse of time, the filter coefficient supply means supplies filter coefficients respectively for different time frames and the control signal generation means generates a control signal which changes its value with lapse of time. The filter coefficient interpolation means interpolates the filter coefficients for the different time frames supplied by the filter coefficient supply means in response to the control signal which is a parameter of interpolation which changes with time. As a result, filter coefficients supplied as the interpolation output to the digital filter change their values smoothly at each interpolation step from a filter coefficient corresponding to one time frame to a filter coefficient corresponding to another time frame whereby smooth timewise change in the tone color can be obtained.

The filter coefficient interpolation system according to the invention is applicable also to a case where timewise change in the filter characteristics is unnecessary. Assume, for example, a case where a tone color change control according to key touch is to be made by variably controlling filter characteristics in accordance with key touch. Even if filter coefficients prepared by the filter coefficient supply means in this case are only two sets of filter coefficients corresponding to a weak key touch and filter coefficients corresponding to a strong key touch, fine filter coefficients can be obtained by generating control signals by the control signal generation means in response to multiple degrees of key touch and performing the filter coefficient interpolation operation using these control signals as a parameter of interpolation whereby a rich tone color change control corresponding to the multiple degrees of key touch can be realized. The same is the case when the control signal is generated on the basis of other tone control elements such as tone pitch or tone range, manual operator output, envelope shape data and low frequency modulating signal.

In another aspect of the invention, the tone signal processing device according to the invention comprises digital filter means receiving a tone signal and filter coefficients for controlling the input tone signal in accordance with characteristics determined by the filter coefficients, filter coefficient memory means for storing plural sets of filter coefficients realizing desired filter characteristics, reference value data determining means for determining reference value data for designating filter coefficient to be read out from the filter coefficient memory means, control data generation means for generating control data for variably controlling tone color, operation means for operating the reference value data and the control data to provide filter coefficient operation data consisting of an integer section and a decimal section, selection means for selecting and reading from the filter coefficient memory means at least two sets of filter coefficients in accordance with the integer section of the filter coefficient operation data, and filter coefficient interpolation means for interpolating the at least two sets of filter coefficients read out by the selection means using the decimal section of the filter coefficient operation data as a parameter of interpolation and supplying filter coefficients obtained by the interpolation to the digital filter means.

According to this device, plural sets of filter coefficients for realizing desired filter characteristics are stored in the filter coefficient memory means and a filter coefficient to be read out from this filter coefficient memory means is basically designated by the reference value data determined by the reference value data determining means. Aside from this reference value data, the control data for variably controlling tone color can be generated by the control data generation means. The operation means operates the reference value data and the control data to obtain the filter coefficient operation data consisting of the integer section and the decimal section. Therefore, the filter coefficient operation data is data obtained by modifying the reference value data by the control data. Selection of filter coefficients to be read out from the filter coefficient memory means is made by the selection means. The selection means selects at least two sets of filter coefficients in accordance with the integer section of the filter coefficient operation data and reads out these filter coefficients from the filter coefficient memory means. The filter coefficient interpolation means interpolates the at least two sets of filter coefficients read out by the selection means and supplies filter coefficients obtained by the interpolation to the digital filter means.

Accordingly, in this case also, fine filter coefficients can be generated according to contents of tone color control so that rich filter characteristics can be realized and a rich tone color change control can thereby be realized without increasing the amount of filter coefficients prepared in the filter coefficient memory means. Besides, filter coefficients to be read out from the filter coefficient memory means are basically designated by the reference value data so that contents stored in the filter coefficient memory means can be utilized in diverse variation and a rich tone color change control can be also realized from this aspect.

In still another aspect of the invention, the tone signal processing device according to the invention comprises digital filter means receiving a tone signal and filter coefficients for controlling the input tone signal in accordance with characteristics determined by the filter coefficients, coefficient memory means for storing sets of filter coefficients realizing desired filter characteristics, each of the plural sets being assigned with coordinate data of two axes, coordinate designation means for designating coordinate data of a coefficient set to be read out from the coefficient memory means, and control means for variably controlling coordinate data of at least one coordinate axis in the coordinate data designated by the coordinate designation means in accordance with tone color control information, a filter coefficient set being read out from the coefficient memory means in response to coordinate data established in accordance with the designation by the coordinate designation means and the variable control by the control means and the read out filter coefficient set being supplied to the digital filter means.

Each set of filter coefficients stored in the coefficient memory means is assigned with coordinate data of at least two axes and a desired set of filter coefficients is read out using this coordinate data as the address. The coordinate data of a coefficient set to be read out is designated by the coordinate designation means. Coordinate data of at least one coordinate axis in the coordinate data designated by the coordinate designation means is variably controlled by the control means in accordance with tone color control information. Thus, a filter coefficient set corresponding to the variably controlled coordinate data is read out from the coefficient memory means. The tone color control information is information based on tone color control elements such as key touch, tone pitch, lapse of time, envelope shape and manual operator output signal.

Preferred embodiments of the invention will now be described with reference to the accompanying drawings.

BRIEF DESCRIPTION OF THE DRAWINGS

In the accompanying drawings,

FIGS. 7–9 are flow charts showing an example of processing executed by a microcomputer section of FIG. 2 in which FIG. 7 shows main routine, FIG. 8 new key-on processing routine and FIG. 9 timer interrupt routine respectively;

FIG. 13 is a graph showing an example of filter characteristics realized by filter coefficient sets in one filter coefficient table in correspondence to coordinate positions to which these filter coefficient sets are assigned;

FIG. 14 is a diagram showing an example of contents stored in a data and working RAM in FIG. 10; and FIGS. 15–18 are flow charts showing an example of processings executed by a microcomputer section of FIG. 10 in which FIG. 15 shows main routine, FIG. 16 new key-on event routine, FIG. 17 filter coefficient operation subroutine and FIG. 18 timer interrupt routine respectively.

DESCRIPTION OF PREFERRED EMBODIMENTS

Figure 1A:
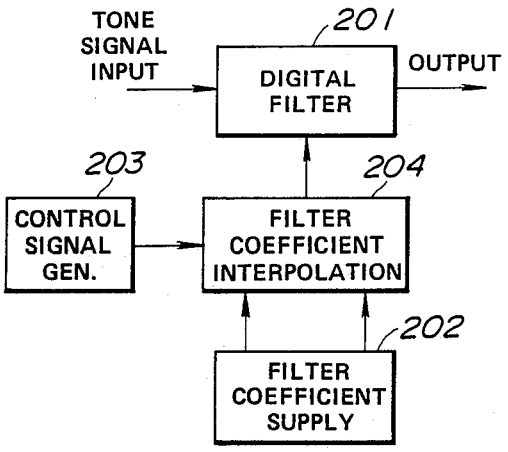
FIGS. 1*a*, 1*b* and 1*c* are block diagrams showing functions of an embodiment of the invention.

Referring to FIG. 1*a*, a digital filter 201 receives a tone signal and filter coefficients and controls the input tone signal in accordance with characteristics determined by the filter coefficients. A filter coefficient supply means 202 supplies at least two sets of filter coefficients corresponding to different filter characteristics. A control signal generation means 203 generates a control signal for controlling tone color. A filter coefficient interpolation means 204 interpolates at least two sets of filter coefficients supplied by the filter coefficient supply means 202 using the control signal generated by the control signal generation means 203 and supplies filter coefficients obtained by the interpolation to the digital filter 201. The control signal generated by the control signal generation means 203 may be tone color control information based on any tone color control elements such as lapse of time, key touch , tone pitch or tone range, output of manual operator, envelope shape data and low frequency modulating signal.

In a case where, for example, timewise change of tone color is to be realized by changing filter characteristics with lapse of time, the filter coefficient supply means 202 supplies filter coefficients respectively for different time frames and the control signal generation means 203 generates a control signal which changes its value with lapse of time. The filter coefficient interpolation means 204 interpolates the filter coefficients for the different time frames supplied by the filter coefficient supply means 202 in response to the control signal which is a parameter of interpolation which changes with time. As a result, filter coefficients supplied as the interpolation output to the digital filter 201 change their values smoothly at each interpolation step from a filter coefficient corresponding to one time frame to a filter coefficient corresponding to another time frame whereby smooth timewise change in the tone color can be obtained.

The filter coefficient interpolation system according to the invention is applicable also to a case where timewise change in the filter characteristics is unnecessary. Assume, for example, a case where a tone color change control in accordance with key touch is to be made by variably controlling filter characteristics in accordance with key touch. Even if filter coefficients prepared by the filter coefficient supply means 202 in this case are only two sets of filter coefficients corresponding to a weak key touch and filter coefficients corresponding to a strong key touch, fine filter coefficients can be obtained by generating control signals by the control signal generation means 203 in response to multiple degrees of key touch and performing the filter coefficient interpolation operation using these control signals as a parameter of interpolation whereby a rich tone color change control corresponding to the multiple degrees of key touch can be realized. The same is the case when the control signal is generated on the basis of other tone control elements such as tone pitch or tone range, manual operator output, envelope shape data and low frequency modulating signal.

Figure 1C:
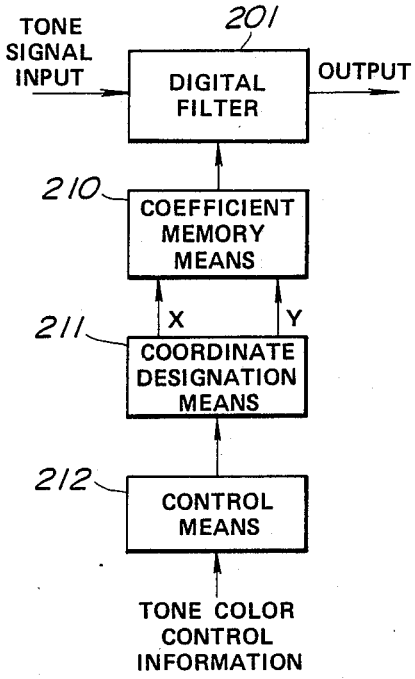
Figure 1B:
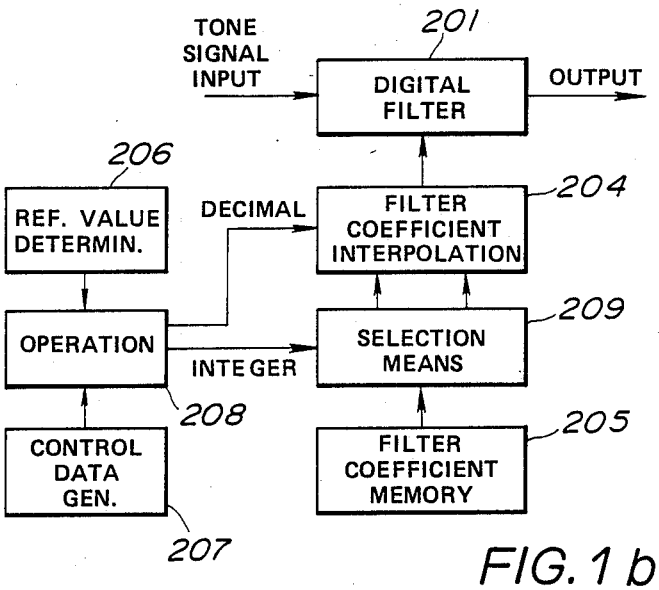

In the embodiment of FIG. 1*b*, filter coefficient memory means 205 stores plural sets of filter coefficients realizing desired filter characteristics. Reference value data determining means 206 determines reference value data for designating filter coefficients to be read out from the filter coefficient memory means 205. Control data generation means 207 generates control data for variably controlling tone color. Operation means 208 operates the reference value data and the control data to provide filter coefficient operation data consisting of an integer section and a decimal section. Selection means 209 selects and reads from the filter coefficient memory means 205 at least two sets of filter coefficients in accordance with the integer section of the filter coefficient operation data. Filter coefficient interpolation means 204 interpolates the at least two sets of filter coefficients read out by the selection means 209 using the decimal section of the filter coefficient operation data as a parameter of interpolation and supplies filter coefficients obtained by the interpolation to the digital filter 201.

Accordingly, in this case also, fine filter coefficients can be generated according to contents of tone color control so that rich filter characteristics can be realized and a rich tone color change control can thereby be realized without increasing the amount of filter coefficients prepared in the filter coefficient memory means 205. Besides, filter coefficients to be read out from the filter coefficient memory means 205 are basically designated by the reference value data so that contents stored in the filter coefficient memory means 205 can be utilized in diverse variation and a rich tone color change control can be also realized from this aspect.

In the embodiment of FIG. 1*c*, coefficient memory means 210 stores sets of filter coefficients realizing desired filter characteristics, each of the plural sets being assigned with coordinate data of two axes. Coordinate designation means 211 designates coordinate data of a coefficient set to be read out from the coefficient memory means 210. Control means 212 variably controls coordinate data of at least one coordinate axis in the coordinate data designated by the coordinate designation means 211 in accordance with tone color control information. A filter coefficient set is read out from the coefficient memory means 210 in response to coordinate data established in accordance with the designation by the coordinate designation means 211 and the variable control by the control means 212 and the read out filter coefficient set is supplied to the digital filter 201. Accordingly, coordinate data of at least one coordinate axis in the coordinate data designated by the coordinate designation means 211 is variably controlled in accordance with tone color control information. Thus, a filter coefficient set corresponding to the variably controlled coordinate data is read out from the coefficient memory means 210 and filter characteristics are variably controlled. The tone color control information is information based on tone color control elements such as key touch, tone pitch, lapse of time, envelope shape and manual operator output signal.

Figure 2:
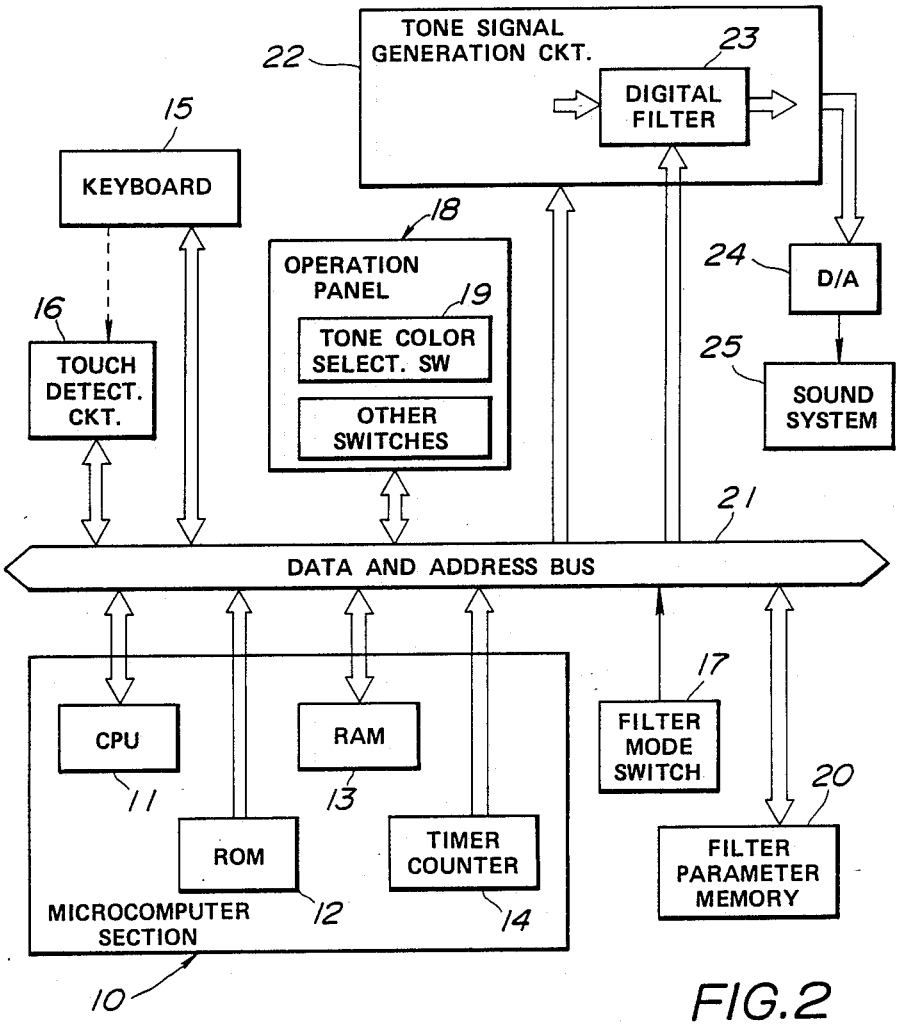
FIG. 2 is a block diagram showing a hardware construction of an embodiment of an electronic musical instrument incorporating the device according to the invention.

FIG. 2 shows a hardware construction of an embodiment of an electronic musical instrument incorporating the invention. In this embodiment, timewise change in filter coefficients is realized by interpolating filter coefficients corresponding to different time frames as time elapses. In the electronic musical instrument of this embodiment, various operations and processings including interpolation operation of filter coefficients are controlled by a microcomputer section 10 including a CPU (central processing unit) 11, a program ROM (read-only memory) 12 and a working RAM (random-access memory) 13. In addition, a timer counter 14 for determining basic timing of the filter coefficient interpolation operation is provided in the microcomputer section 10. This timer counter 14 is stepped at a predetermined time interval (e.g., every 2 ms) by a predetermined clock pulse.

A keyboard 15 comprises keys for designating tone pitches of tones to be generated. A touch detection circuit 16 is provided for detecting touch of a key depressed in the keyboard with a suitable resolution, e.g., 32 stages. The kind of touch to be detected may either be an initial touch or an after touch.

A filter mode switch 17 is provided for selecting one of two filter coefficient interpolation modes. In the present embodiment, the filter coefficient interpolation operation can be selectively made in accordance with either one of these two modes. The selection of the mode is made by a filter mode switch 17.

In the first mode (hereinafter referred to as mode "0"), the interpolation operation is performed on the basis of difference between two filter coefficients corresponding to adjacent time frames.

In the second mode (hereinafter referred to as mode "1"), the interpolation operation is performed on the basis of at least one of two filter coefficients corresponding to adjacent time frames and a prepared coefficient difference value. Details of these modes will become apparent as the description proceeds.

In an operation panel section 18, there are provided a tone color selection switch 19 and various other switches and operation knobs for establishing and controlling tones.

A filter parameter memory 20 prestores multiple sets of filter coefficients corresponding to plural time frames in correspondence to tone color determining factors such as tone colors, tone pitches and key touches. One set of filter coefficients corresponding to plural time frames is selected in accordance with the tone color kind selected by the tone color selection switch 19, tone pitch of the key depressed in the keyboard 15 and key touch of the depressed key detected by the touch detection circuit 16 and filter coefficients corresponding to respective time frames are sequentially and successively read out from the memory 20 with lapse of time during which the tone is sounded. The read out filter coefficients of the respective frames are supplied to the microcomputer section 10. In the microcomputer section 10, operation for interpolating filter coefficients of adjacent time frames is performed and resulting interpolated output filter coefficient obtained in each interpolation step is supplied to a digital filter 23 in a tone signal generation circuit 22 through a data and address bus 21. This filter parameter memory 20 may consist of an internal ROM provided inside the electronic musical instrument or consist of an external ROM or other detachable external memory medium.

The tone signal generation circuit 22 generates a digital tone signal having tone pitch corresponding to the depressed key in response to information of the depressed key (i.e., key code and key-on signal) supplied through the data and address bus 21 and supplies this digital tone signal to the digital filter 23 to apply a tone control in accordance with the filter characteristics of this digital filter 23. As to the tone signal generation system, any type of tone signal generation system may be employed. Any known system such, for example, as a memory reading system according to which tone waveshape sample value data stored in a waveshape memory in accordance with phase address data which changes at a rate corresponding to the tone pitch designated by the key code is sequentially read out, an FM system according to which tone waveshape sample value data is obtained by executing a predetermined frequency modulation operation using the phase address data as phase angle parameter data, and an AM system according to which tone waveshape sample value data is obtained by executing a predetermined amplitude modulation operation using the phase address data as phase angle parameter data. In the case of the memory reading system, a tone waveshape stored in the waveshape memory may be a waveshape of one period only but a waveshape of plural periods is preferable for improving the tone quality. As a system in which a waveshape of plural periods is stored in and read out from a waveshape memory, there are some known systems such as a system as disclosed by Japanese Preliminary Patent Publication No. 121313/1977 according to which a complete waveshape from start of sounding of a tone to the end thereof is stored and read out once, a system as disclosed by Japanese Preliminary Patent Publication No. 142396/1983 according to which a waveshape of plural periods of an attack portion and a waveshape of one period or plural periods of a sustain portion are stored and, in reading, the waveshape of the attack portion is read once and thereafter the waveshape of the sustain portion is repeatedly read out, and a system as disclosed by Japanese Preliminary Patent Publication No. 147793/1985 according to which plural waveshapes which have been sampled dispersely are stored, a waveshape to be designated for reading out is sequentially changed timewise and the designated waveshape is repeatedly read out. Any of these systems may be selectively employed. An example of such system for generating a high quality digital tone signal by accessing a waveshape memory storing a waveshape of Application No. 86835/1986 according to which waveshape data to be stored in a waveshape memory is data-compressed by a suitable method such as LPC to save memory capacity.

The digital filter 23 receives the digital tone signal and the filter coefficient obtained by the interpolation and controls the input tone signal in accordance with filter characteristics determined by this filter coefficient. Any type of digital filter may be used as the digital filter 23. Classifying digital filters in terms of the operation type, there are two basic types of digital filters, namely a finite impulse response (FIR) filter and an infinite impulse response (IIR) filter. An FIR filter is more convenient in its designability, stability and suitability for tone control. In using an FIR filter, an example of a type in which the filter coefficient is changed timewise is disclosed in Japanese Patent Application No. 26754/1985 and such digital filter may be employed.

A digital tone signal generated by the tone signal generation circuit 22 is converted to an analog signal by a digital-to-analog converter 24 and supplied to a sound system 25.

Figure 3:
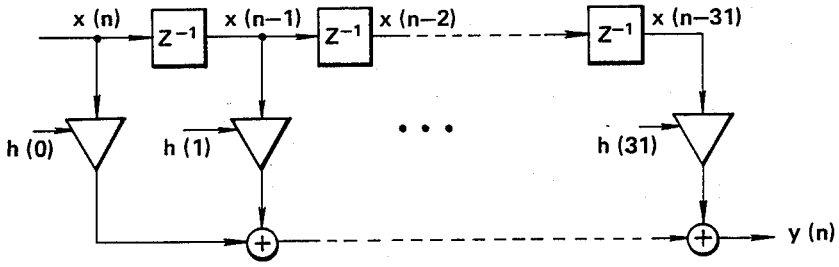
FIG. 3 is a block diagram showing an example of digital filter constructed of an FIR filter of 32 orders.

FIG. 3 is a diagram showing a basic construction of the digital filter 23 constructed of an FIR filter of 32 orders. In the figure, x(n) is digital tone waveshape sample value data at any n-th sample point in an input tone signal. $z^{-1}$ represents a unit time delay element which determines time delay in one sampling period. Accordingly, x(n−1) represents digital tone waveshape sample value data at the n−1-th sample point and x(n−31) represents digital tone waveshape sample value data at the n−31-th sample point. h(0)–h(31) are filter coefficients of 32 orders. The triangular block to which the filter coefficient is applied represents a multiplication element which multiplies data of the respective sample points which have been delayed by the delay elements with corresponding ones of filter coefficients h(0)–h(31). Blocks affixed with + symbols to which the output of the multiplication element is applied are addition elements which add the multiplication outputs together and provide an output signal y(n).

A feature of such FIR filter is that it can obtain linear phase characteristics. By using linear phase, phase of input waveshape of the filter corresponds to phase of output waveshape thereof in complete linear characteristics so that occurrence of distortion in the waveshape can be prevented. This is preferable for filter processing of audio signals such as voice and tone. A necessary and sufficient condition of the FIR filter having such linear phase characteristics is that its impulse response is of a symmetrical characteristic. The symmetrical characteristic of the impulse response means that the filter coefficients h(0)–h(31) have a symmetrical characteristic. In other words, by establishing the filter coefficients with a symmetrical characteristic, the above described linear phase characteristics can be realized. In this case, filter coefficients at orders of symmetrical positions have the same value so that it is not necessary to prepare filter coefficients for all of orders N (=32) but half of the orders N will suffice. More specifically, in a case where N is an even number as in this example, 16 filter coefficients from the zero-th to the fifteenth orders have only to be prepared and filter coefficients at symmetrical positions of the zero-th to the fifteenth orders may be utilized as filter coefficients from the sixteenth to the thirty-first orders. In the present embodiment, therefore, 16 filter coefficients from the zero-th to the fifteenth orders are actually produced and these filter coefficients are used directly as those from the zero-th to the fifteenth orders and also as those from the sixteenth to the thirty-first orders which are at symmetrical positions by folding these filter coefficients.

Another feature of the FIR filter is that it has excellent stability for the reason that it has no feedback loop. The IIR filter which has a feedback loop is accompanied by the problem of oscillation whereas the FIR filter has no such problem and so design of the filter is easy.

The FIR filter is also convenient in a case where its filter characteristics should be changed with lapse of time as in the present invention. In this case, according to the prior art, sets of filter coefficients must be prepared in correspondence to respective filter characteristics which differ with time and, as previously mentioned, a large number of sets of filter coefficients are required if fine timewise variation of filter characteristics is desired. For overcoming this problem, according to the invention, two sets (i.e., two frames) of filter characteristics which are somewhat timewise distant from each other are prepared and sets of filter characteristics are densely produced during lapse of time between the two sets by performing interpolation. Thus, filter characteristics which change with time are obtained by filter coefficients which have been produced by the interpolation. In realizing the timewise changing filter characteristics while interpolation of filter coefficients is performed in real time, the FIR filter which has excellent stability is particularly advantageous because it is not necessary to pay particular attention to designing of filter coefficients.

Figure 4:
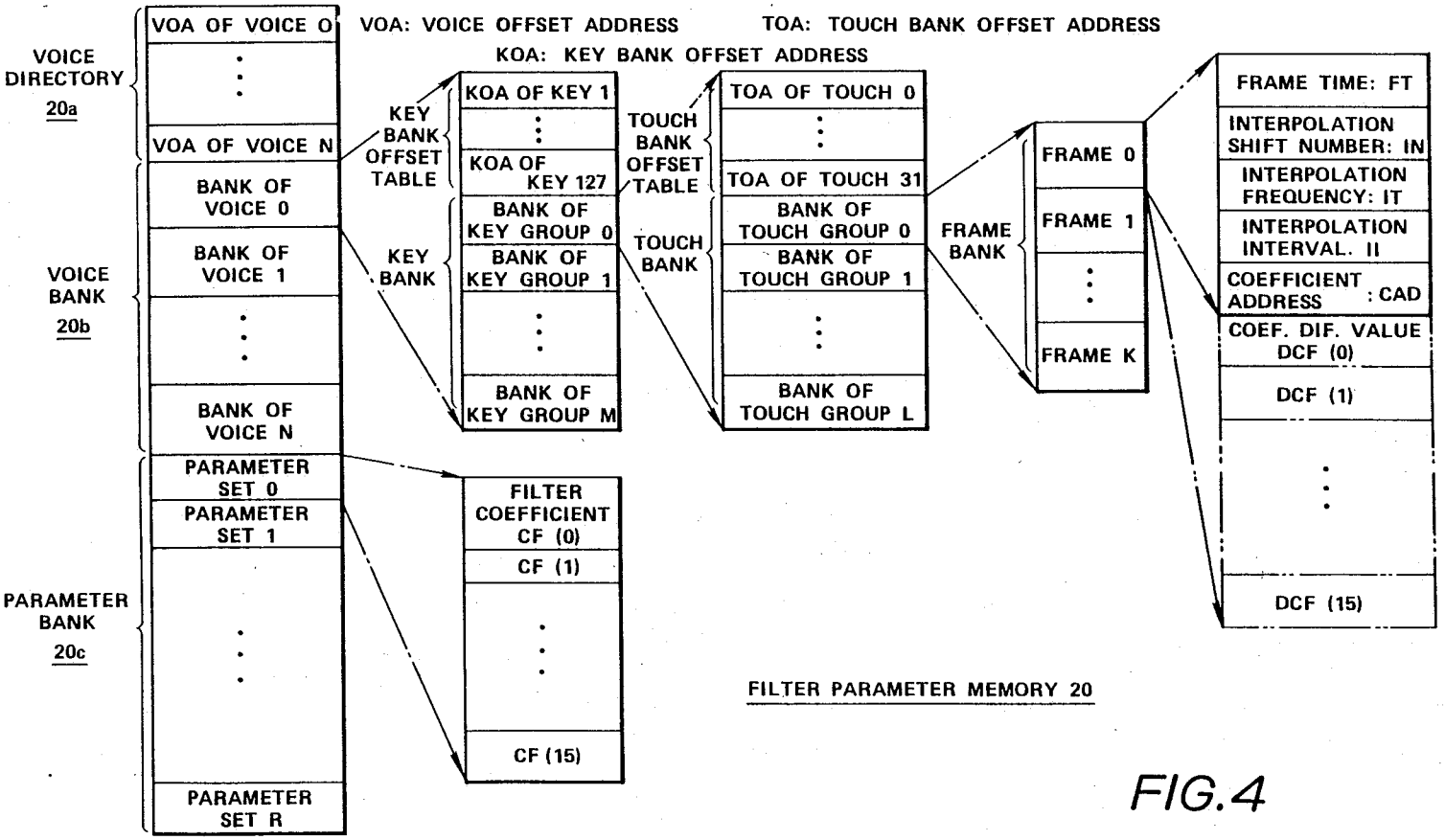
FIG. 4 is a diagram showing an example of a memory format of a filter parameter memory shown in FIG. 2.

FIG. 4 shows an example of a memory format of the filter parameter memory 20 which consists of voice directory 20*a*, voice bank 20*b* and parameter bank 20*c*. Actual filter coefficients are stored in the parameter bank 20*c*. The voice bank 20*b* stores address data for reading out filter coefficients which are determined depending upon combination of tone color determining factors consisting of tone color kind, tone pitch and key touch from the parameter bank 20*c* and stores also parameter data for filter coefficients interpolation operation.

The voice directory 20*a* stores voice offset address VOA in correspondence to plural kinds of tone color (voices 0–N). In response to a tone color code representing a tone color selected by the tone color selection switch 19, a voice offset address VOA corresponding to the tone color code is read out from this voice directory 20*a*. The voice offset address VOA is data indicating initial address of a memory bank corresponding to each voice 0–N in the voice bank 20*b*.

The voice bank 20*b* consists of memory banks (voice banks) corresponding to the respective voices 0–N. As illustrated by way of example with respect to voice 0, each voice bank consists of a key bank offset table and a key bank corresponding to plural key groups (key groups 0–M).

The key bank offset table stores key bank offset address KOA in correspondence to keys of the keyboard 15. In response to the key code of the depressed key, key bank offset address KOA corresponding to the key group to which the depressed key belongs is read out from the key bank offset table. The key bank offset address KOA is data indicating initial address of a memory bank corresponding to each of the respective key groups 0–M and consists of relative address data in that voice bank.

The key bank consists of memory banks (key banks) corresponding to the respective key groups 0–M. The key bank corresponding to the respective key groups consists of a touch bank offset table and touch banks corresponding to respective touch groups (touch groups 0–L).

The touch bank offset table stores touch offset address TOA corresponding to respective stages of 32-stage touch data which is detectable by the touch detection circuit 16. In response to touch data detected by the touch detection circuit 16, touch bank offset address TOA corresponding to the touch group to which the touch data belongs is read out from the touch bank offset table. The touch bank offset address TOA is data indicating initial address of a memory bank of each touch group 0–L and consists of relative address data in that key bank.

The touch bank consists of memory banks (touch banks) corresponding to the respective touch groups 0–L. The touch bank corresponding to each touch group consists of plural time frames (frames 0–K) as illustrated by way of example with respect to touch group 0.

Frame banks corresponding to the respective frames 0–K store, as illustrated by way of example with respect to frame 0, interpolation operation parameter data FT, IN, IT and II and coefficient address data CAD for the respective frames. Further, the frame banks store, if necessary, coefficient difference value data DCF (0)–DCF (15) for the above mentioned mode "1".

More specifically, filter parameter memories 20 having different storage contents are separately provided for the modes "0" and "1". In the filter parameter memory 20 for the mode "0", one frame bank consists of 8 addresses at which the interpolation operation parameters FT, IN, IT and II and the coefficient address data CAD are stored. In the filter parameter memory 20 for the mode "1", one frame bank consists of 40 addresses at which the interpolation operation parameter data FT, IN, IT and II, coefficient address data CAD and coefficient difference value data DCF(0)–DCF(15) are stored. Either one of the filter parameter memory 20 for the mode "0" and the filter parameter memory 20 for the mode "1" may be mounted on the electronic musical instrument as a factory set and the filter mode switch 17 may be switched in accordance with the mode of the mounted memory. Alternatively, both the filter parameter memories 20 for the modes "0" and "1" may be mounted on the electronic musical instrument and one of these memories 20 may be accessed in accordance with the mode selected by the filter mode switch 17.

Parameter data for the interpolation operation will now be described.

Frame time data FT represents duration of the particular frame. The frame time data is "0" in the last frame and some data representing duration of time other than "0" in other frames. The last frame is sustained until sounding of a tone is finished so that its duration time is indefinite. For this reason, FT="0" in the last frame.

Interpolation shift number data IN is data which represents the amount of shift in shifting difference in filter coefficients of adjacent frames. This interpolation shift number data IN is a logarithm of interpolation frequency data IT to be described below.

Interpolation frequency data IT is data which represents the number of times (number of interpolation steps) the interpolation is performed for interpolating the filter coefficients between the adjacent frames.

Interpolation interval data II is data which represents the duration of one interpolation step.

Coefficient address data CAD is an address data for reading out filter coefficient corresponding to a particular frame form the parameter bank 20*c*.

The parameter bank 20*c* stores sets of filter coefficients of plural kinds (parameter sets 0–R). One set of filter coefficients consists, as illustrated by way of example with respect to parameter set 0, of 16 filter coefficients CF(0)–CF(15) from the zero-th to the fifteenth orders. One set of the parameter sets 0–R stored in the parameter bank 20*c* is designated by coefficient address data CAD read out from the frame bank and one set of the filter coefficient sets CF(0)–CF(15) corresponding to the designated parameter set is read out.

Relative address of a frame bank corresponding to one of the frames 0–K in one touch bank is designated by frame number FN. Each frame 0–K corresponds to a time sequence so that the frame is frame 0 at the start of sounding of the tone and the frame is switched to frames 1, 2, 3 . . . as a predetermined period of time elapses. The frame number FN is data representing the frame at the present time point. As described above, the number of the address of one frame bank is, for example, 8 in the case of the mode "0" and 40 in the case of the mode "1". More specifically, therefore, the relative address in a frame bank corresponding to each of the frames 0–K is "FN×8" in the mode "0" and "FN×40" in the mode "1".

An absolute address (hereinafter referred to as frame address FAD) in a desired frame bank in the filter parameter memory 20 is determined by the following operation formula using the voice offset address VOA, key bank offset address KOA and touch bank offset address TOA read out from the voice directory 20*a*, key bank offset table and touch bank offset table:

In the case of the mode "0":

$$FAD = VOA + KOA + TOA + FN \times 8$$

In the case of the mode "1":

$$\mathrm{FAD} = \mathrm{VOA} + \mathrm{KOA} + \mathrm{TOA} + \mathrm{FN} \times 40$$

That is, to the voice offset address VOA representing the initial address of the voice bank to be accessed is added the key bank offset address TOA which is relative address thereto and further is added the touch bank offset address TOA which is relative address thereto and further is added the frame bank relative data "FN×8" or "FN×40" which is relative address thereto. In actual design, for saving the memory capacity, the respective offset addresses VOA, KOA and TOA are expressed in 1/16 in VOA, $\frac{1}{8}$ in KOA and $\frac{1}{8}$ in VOA. In this case, the frame address FAD is determined by correcting values of the respective offset addresses data as follows:

In the case of the mode "0":

$$FAD = VOA \times 16 + KOA \times 8 + TOA \times 8 + FN \times 8$$

In the case of the mode "1":

$$\mathrm{FAD} = \mathrm{VOA} \times 16 + \mathrm{KOA} \times 8 + \mathrm{TOA} \times 8 + \mathrm{FN} \times 40$$

The storied structure of the filter parameter 20 as shown in FIG. 4 is advantageous for saving of the memory capacity. If filter coefficients are stored individually for all combinations of tone color kinds, key groups and touch groups, a tremendous amount of memory capacity will be required. By employing the storied structure as shown in FIG. 4, the memory capacity required is greatly reduced. Since, in FIG. 4, there is a case where a common filter coefficient can be used for different combinations of tone color kinds, key groups and touch groups, the number of parameter sets 0–R stored in the parameter bank 20*c* FIG. 4 is by far smaller than the number of combinations of tone color kinds, key groups and touch groups whereby the memory capacity can be saved.

An outline of the two filter coefficient interpolation modes will be described.

Figure 5:
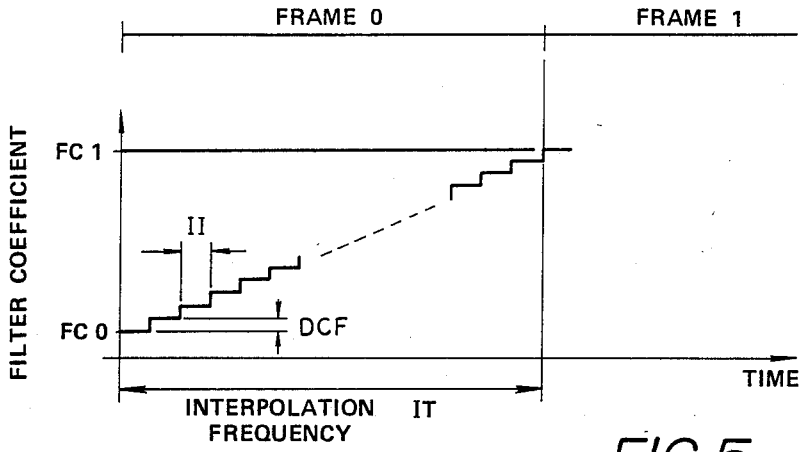
FIG. 5 is a diagram for explaining an example of interpolation of filter coefficients.

Mode "0":

In this mode, interpolation operation is performed on the basis of difference between two filter coefficients corresponding to adjacent time frames. Referring to FIG. 5, description will be made about frame 0 and frame 1 which are adjacent to each other. Filter coefficient corresponding to the frame 0 is represented by FC0 and filter coefficient corresponding to the frame 1 by FC1. Difference between the two coefficients (FC1-FC0) is obtained and this difference is shifted in accordance with the interpolation shift number data IN. This is equivalent to division by the interpolation frequency data IT if shown by an operation formula. A coefficient difference value DCF is thereby obtained as follows:

$$(FC1-FC0)/IT=DCF$$

The interpolation operation is performed by accumulating this coefficient difference value DCF to the filter coefficient FC0 corresponding to the frame 0 at each one interpolation step time determined in accordance with the interpolation interval data II. Thus, the filter coefficient obtained by the interpolation operation gradually increases (or decreases), starting from FC0, by the coefficient difference value DCF at each interpolation step and, when accumulation of the same number of times as the interpolation frequency data IT has finally been completed, the filter coefficient reaches a value corresponding to the filter coefficient FC1. As the frame is changed, the same interpolation operation as described above is performed with respect to next adjacent frames 1 and 2. Such interpolation operation is made for each order.

The mode "1":

In this mode, the interpolation operation is performed on the basis of at least one of the two filter coefficients corresponding to adjacent time frames and also a prepared coefficient difference value. In the above described mode "0", the coefficient difference value DCF is obtained by calculation whereas in the mode "1", coefficient difference values DCF(0)-DCF(15) corresponding to the respective orders are prestored in the frame bank of the filter parameter memory 20 and, therefore, the necessity for calculation for obtaining the coefficient DCF is obviated. Accordingly, in the mode "1", the interpolation operation with respect to the frames 0 and 1 is performed by accumulating the coefficient difference value DCF read out from the frame bank to the filter coefficient FC0 corresponding to the frame 0 at each interpolation step time determined by the interpolation interval data II. When accumulation of the same number of times as the interpolation frequency data IT has been completed, the interpolation for the time frames 0 and 1 is completed. As the frame is changed, the same interpolation operation is performed with respect to next adjacent frames 1 and 2.

Figure 6:
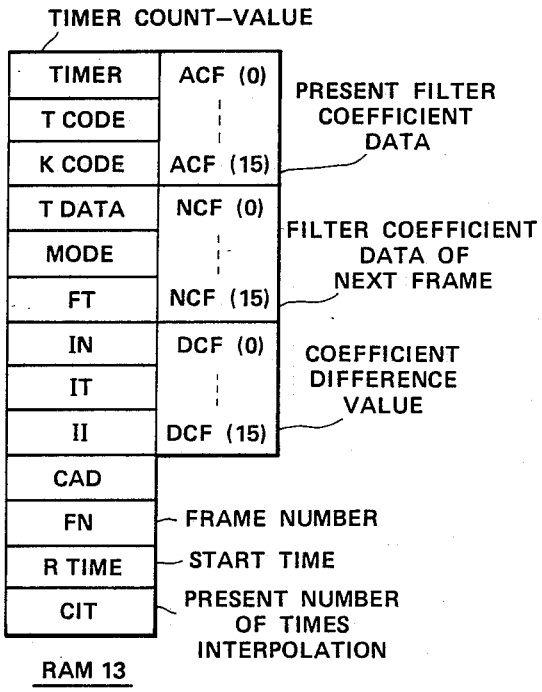
FIG. 6 is a diagram showing an example of contents stored in a data and working RAM shown in FIG. 2.
Figure 7:
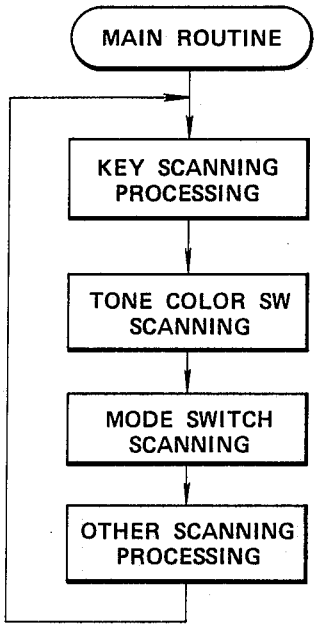
Figure 8:
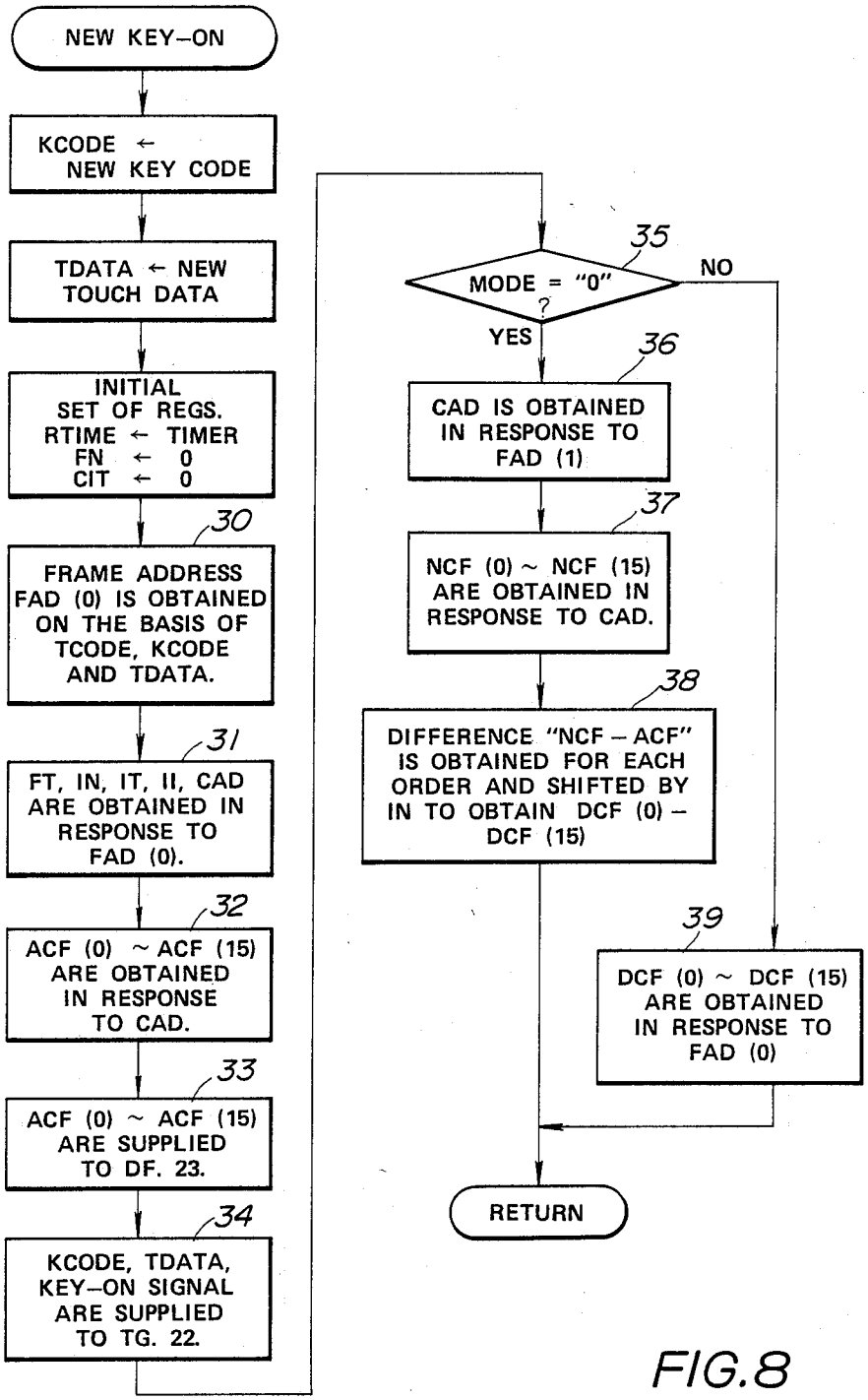
Figure 9:
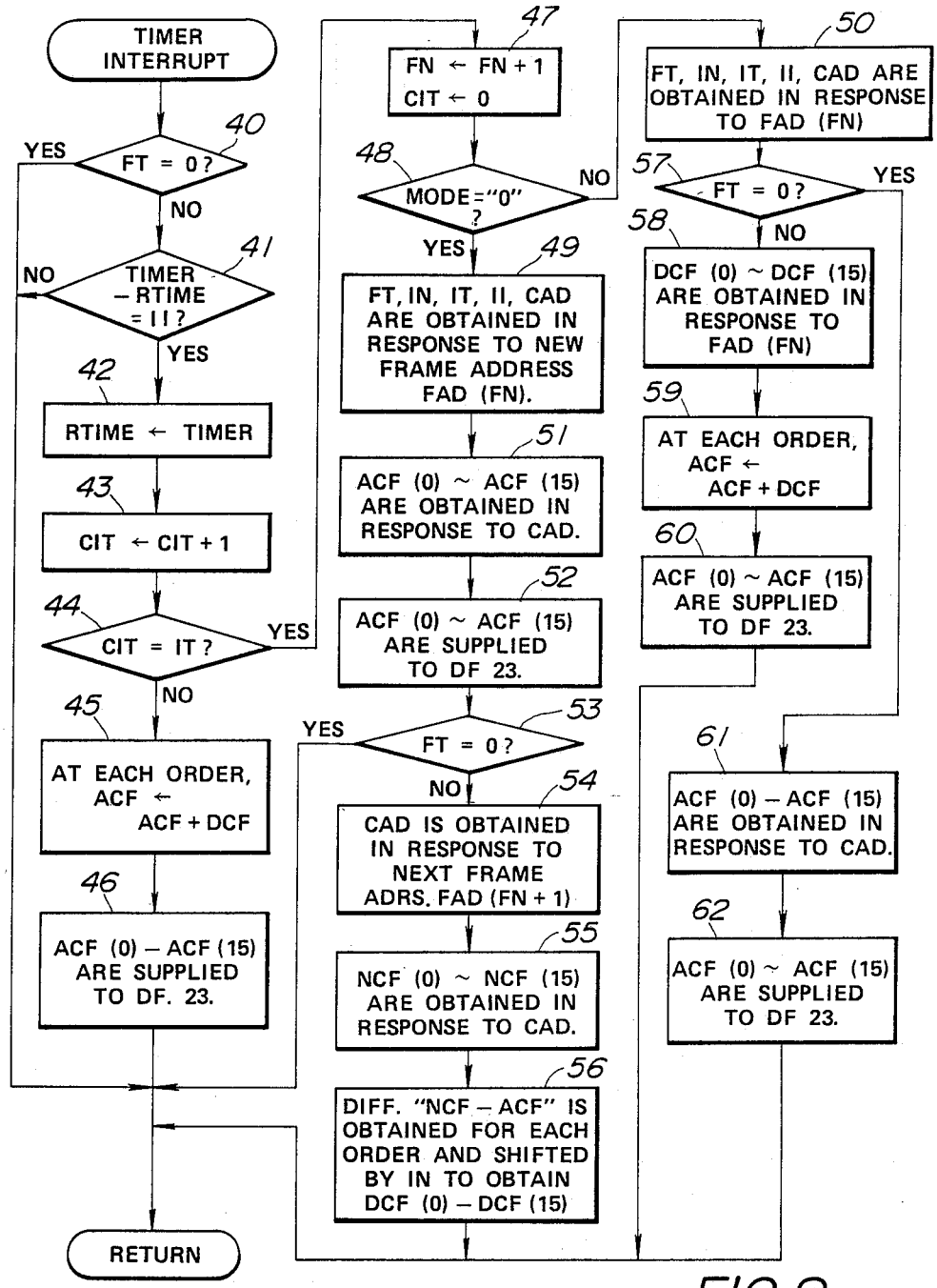

An example of a flow chart showing processings relating to this invention among processings executed by the microcomputer section 10 is shown by FIGS. 7 through 9. An example of data used with respect to these processings and contents stored in the working RAM 13 is shown in FIG. 6.

In these figures, TIMER represents timer count value which is a count of the timer counter 14 (FIG. 2) which is stepped at a predetermined timing (e.g., 2 ms).

TCODE represents tone color code which represents a tone color selected by the tone color selection switch 19 (FIG. 2).

KCODE represents key code which represents a key depressed in the keyboard 15 (FIG. 2).

TDATA represents touch data which represents key touch detected by the touch detection circuit 16 (FIG. 2).

FT, IN, IT and II represent the above described interpolation operation parameters and CAD represents the above described coefficient address. These data corresponding to the present frame read out from the filter parameter memory 20 in the previously described manner are stored in the RAM 13.

FN represents the above described frame number and represents the present frame.

RTIME represents start time and stores timer count value TIMER at the start of one interpolation step.

CIT represents present number of times of interpolation (number of interpolation steps).

ACF(0)-ACF(15) represent present filter coefficient data CF(0)-CF(15) from the zero-th to the fifteenth orders which change as the interpolation proceeds. As described previously, these data can be used also as the filter coefficients data from the sixteenth to the thirty-first orders. More specifically, the present filter coefficient data ACF(0)-ACF(15) are supplied as the filter coefficients h(0)- h(15) from the zero-th to the fifteenth orders in FIG. 3 and the present filter coefficient data ACF(15)-ACF(0) are reversely supplied in a symmetrical manner as the filter coefficients h(16)-h(31) from the sixteenth to the thirty-first orders.

NCF(0)-NCF(15) represent filter coefficient data CF(0)-CF(15) from the zero-th to the fifteenth orders corresponding to next frame.

DCF(0)-DCF(15) represent the above described coefficient difference value data corresponding to the zero-th to the fifteenth orders. As described above, these data are obtained by calculation in the mode "0" and read out from the filter parameter memory 20 in correspondence to the present frame in the mode "1".

An area for storing the above described data or signals is provided in the data and working RAM 13. Also provided in the data and working RAM 13 are areas for storing key data of depressed keys (key codes and key-on signals), operation detection data for switches and operation knobs in the operation panel 18 and ON/OFF data of LED etc.

FIG. 7 shows the main routine. In "key scanning processing", on-off states of respective keys in the keyboard 15 are detected and, if depression of a new key has been detected, "new key-on processing" in FIG. 8 is executed. For brevity of explanation, in the present embodiment, a tone corresponding to a newly depressed key is sounded in a single tone preference system.

In "tone color switch scanning processing", the tone color selection switch 19 is scanned, the tone color code of the selected tone color is stored as the tone color code TCODE and this tone color code is supplied to the tone signal generation circuit 22.

In "mode switch scanning processing", the filter mode switch 17 is scanned to examine which of the modes "0" and "1" has been selected. If the mode "0" has been selected, the mode data MODE is made "0"

whereas if the mode "1" has been selected, the mode data MODE is made "1".

In the main routine, other switches and operation knobs in the operation panel 18 are scanned and necessary processings are executed.

Upon detection of depression of a new key in the keyboard 15, the new key-on processing in FIG. 8 is executed. In this processing, the key code of the newly depressed key is stored as the key code KCODE. Then, in response to this newly depressed key, touch data detected by the touch detection circuit 16 is stored as the touch data TDATA.

Nextly, contents of respective registers are initially set. For example, processings such as setting the timer count value TIMER to the start time RTIME (i.e., setting the start time of the initial interpolation step to RTIME), resetting the frame number FN to "0" and resetting the present number of times of interpolation CIT to "0" are executed.

In next step 30, the offset addresses VOA, KOA and TOA are read out from the filter parameter memory 20 in response to the tone color code TCODE, key code KCODE and touch data TDATA and the frame address FAD is calculated in the previously described manner in accordance with these offset addresses VOA, KOA and TOA and the frame number FN. Since the frame number initially is FN="0", frame address FAD(0) of the frame 0 is obtained.

In next step 31, in response to the calculated frame address FAD, the above described various interpolation operation parameters FT, IN, IT and II and the coefficient address CAD are read out from the frame bank of the filter parameter memory 20 and the read out data are stored in a register in the RAM 13.

In next step 32, in response to the coefficient address CAD, a set of filter coefficients is read out from the parameter bank 20*c* of the filter parameter memory 20 and the read out set is stored as present filter coefficient data ACF(0)–ACF(15) in a register in the RAM 13.

In next step 33, the present filter coefficient data ACF(0)–ACF(15) are supplied to the digital filter 23 in the tone signal generation circuit 22. In step 34, the key code KCODE, touch data TDATA and key-on signal are supplied to the tone signal generation circuit 22. The reason for executing these steps 33 and 34 before next steps 35–38 is that processings of the steps 35–38 take time so that supply of the data to the tone signal generation circuit 22 is made before the steps 35–38 for preventing delay in start of sounding of the tone.

In next step 35, whether the mode data MODE is "0" or not is examined. If result is YES, i.e., the mode is "0", the processing proceeds to steps, 36, 37 and 38 where calculation for obtaining coefficient difference value data DCF(0)–DCF(15) for interpolation is performed. In step 36, frame address FAD(1) concerning the frame 1 which is next to the frame 0 is calculated and the coefficient address CAD concerning the frame 1 is read out from the frame bank in the filter parameter memory 20 in response to this frame address FAD(1). In step 37, a set of filter coefficients is read out from the parameter bank 20*c* of the filter parameter memory 20 in response to the coefficient address CAD obtained in the preceding step and this set of filter coefficients is stored as filter coefficient data NCF(0)–NCF(15) for next frame in a register in the RAM 13. In step 38, difference between the filter coefficient data NCF(0) NCF(15) of the next frame and the present filter coefficient data ACF(0)–ACF(15) (e.g., "NCF(0)–ACF(0)" in the zero-th order) is calculated for each order and the coefficient difference value data DCF(0)–DCF(15) is calculated by shifting the difference in accordance with the interpolation shift number data IN. The coefficient difference value data DCF(0)–DCF(15) obtained is stored a register in the RAM 13.

In the mode "1", the processing proceeds from step 35 to step 39 in which, as described above, the coefficient difference value data DCF(0)–DCF(15) stored in the frame banks of the filter parameter memory 20 are read out from the frame bank corresponding to the frame address FAD(0) and the read out coefficient difference value data DCF(0)–DCF(15) are stored in a register in the RAM 13.

After the above described new key-on processing, a timer interrupt routine in FIG. 9 is executed each time the timer count value TIMER is counted up (every 2 ms) and the interpolation operation is performed according to this routine.

Referring to FIG. 9, in step 40, whether the frame time data FT is "0" or not, i.e., whether the present frame is the last frame or not, is examined. Since interpolation is not performed in the last frame, if the present frame is the last frame, the processing directly proceeds to "return". If the present frame is not the last frame, the processing proceeds to step 41.

In step 41, whether the difference between the timer count value TIMER and the start time RTIME has reached one interpolation step time set in accordance with the interpolation interval data II or not is examined. In other words, whether one interpolation step time has elapsed or not is examined. If this time has not elapsed yet, the processing proceeds to "return" whereas if it has elapsed, the processing proceeds to step 42.

In step 42, the timer count value TIMER is set as the start time RTIME. The start time of next one interpolation step time is set to RTIME. In next step 43, the present number of times of interpolation CIT is increased by 1. In next step 44, whether the number of times of interpolation CIT which has been increased by 1 has coincided with the interpolation frequency data IT or not, i.e., whether the interpolation has been completed or not, is examined.

If the interpolation has not been completed yet, the processing proceeds to step 45 in which the coefficient difference value data DCF(0)–DCF(15) is added to the present filter coefficient data ACF(0)–ACF(15) at each order and results of the addition are used as new present filter coefficient data ACF(0)–ACF(15) (e.g., "ACF(0) ACF(0)+DCF(0) in zero-th order). In this manner, the operation of next one interpolation step is performed. In step 46, the present filter coefficient data ACF(0)–ACF(15) which are new interpolation outputs are supplied to the digital filter 23 in the tone signal generation circuit 22.

As the routine from step 41 to step 46 is repeated, step 44 becomes YES and the processing proceeds to step 47. In step 47, the frame number FN is increased by 1 and the present number of times of interpolation CIT is reset to "0". Thus, the frame is changed.

In next step 48, whether the mode data MODE is "0" or not is examined. If it is YES, i.e., the mode "0", the processing proceeds to step 49. If it is NO, i.e., the mode "1", the processing proceeds to step 50.

In step 49, new frame address FAD is calculated in response to the above described offset addresses VOA, KOA and TOA and the new frame number FN. If, for example, the new frame number FN is "1", the frame address FAD(1) of the frame 1 is obtained. In this case, since one frame bank consists of 8 addresses when the mode is "0", the new frame address FAD can be obtained by adding 8 to the frame address FAD of the preceding frame. In response to the calculated frame address FAD, the above described various interpolation operation parameters FT, IN, IT and II and the coefficient address CAD are read out from the frame bank of the filter parameter memory 20 and these data are stored in a register in the RAM 13.

In step 50, as in step 49, new frame address FAD is calculated in response to the above described offset addresses VOA, KOA and TOA and new frame number FN and, in response to the calculated frame address FAD, the above described various interpolation parameters FT, IN, IT and II and the coefficient address CAD are read out from the frame bank of the filter parameter memory 20 and these data are stored in a register in the RAM 13. Since, however, one frame bank consists of 40 addresses when the mode is "1", new frame address FAD can be obtained by adding 40 to the frame address FAD of the preceding frame.

In the mode "0", the processing proceeds to step 51 after step 49. In steps 51 and 52, as in steps 32 and 33 in FIG. 8, a set of filter coefficients is read out from the parameter bank 20*c* of the filter parameter memory 20 in response to the coefficient address CAD, this set of filter coefficients is stored as present filter coefficient data ACF(0)–ACF(15) in a register in the RAM 13 and these present filter coefficient data ACF(0)–ACF(15) are supplied to the digital filter 23 in the tone signal generation circuit 22. In step 53, whether the frame time data FT is "0" or not, i.e., whether the new frame is the last frame or not, is examined. If it is the last frame, the processing proceeds to return since interpolation is not performed in the last frame. If it is not the last frame, the processing proceeds to step 54.

In steps 54, 55 and 56, approximately the same processings as in steps 36, 37 and 38 in FIG. 8 for obtaining coefficient difference value data DCF(0)–DCF(15) for interpolation are executed. In step 54, frame address FAD(FN+1) for a frame FN+1 which is next to new frame FN is calculated and, in response to this frame address FAD(FN+1), coefficient address CAD for the frame FN+1 is read out from the frame bank of the filter parameter memory 20. In step 55, in response to the coefficient address CAD for the frame FN+1 obtained in the preceding step, a set of filter coefficients is read out from the parameter bank 20*c* of the filter parameter memory 20 and this set of filter coefficients is stored as filter coefficient data NCF(0)–NCF(15) of next frame in a register in the RAM 13. In step 56, the difference between filter coefficient data NCF(0)–NCF(15) for next frame and present filter coefficient data ACF(0)–ACF(15) (e.g., "NCF(0)–ACF(0)" in the zero-th order) is obtained for each order. By shifting this difference in accordance with the interpolation shift number data IN, coefficient difference value data DCF(0)–DCF(15) are obtained and the coefficient difference value data DCF(0)–DCF(15) thus obtained are stored in a register in the RAM 13.

In the mode "1", the processing proceeds to step 57 after step 50. In step 57, whether the frame time data FT is "0" or not, i.e., whether the new frame is the last frame or not, is examined. If it is not the last frame, the processing proceeds to step 58 in which, as in step 39 in FIG. 8, coefficient difference value data DCF(0)–DCF(15) already stored in the frame bank of the filter parameter memory 20 are read out from the frame bank corresponding to the new frame address FAD(FN) and the read out coefficient difference value data DCF(0)–DCF(15) are stored in a register in the RAM 13. In next steps 59 and 60, as in the above described steps 45 and 46, new coefficient difference value data DCF(0)–DCF(15) are added to present filter coefficient data ACF(0)–ACF(15) for each order and results of the addition are used as new present filter coefficient data ACF(0)–ACF(15), and the present filter coefficient data ACF(0)–ACF(15) which are new interpolation outputs are supplied to the digital filter 23 in the tone signal generation circuit 22. In this case, even if the frame is changed, reading of filter coefficients corresponding to new coefficient address CAD and renewal of the present filter coefficients ACF(0)–ACF(15) by the new filter coefficients are not performed but the coefficient difference value data DCF(0)–DCF(15) corresponding to the new frame are accumulated to the old present data ACF(0)–ACF(15).

In the last frame of the mode "1", the processing proceeds from YES of step 57 to step 61. In steps 61 and 62, the same processings as in steps 51 and 52 are executed. In this case, a set of filter coefficients is read out from the parameter bank 20*c* of the filter parameter memory 20 in response to coefficient address CAD corresponding to the last frame, this set of filter coefficients is stored as present filter coefficient data ACF(0)–ACF(15) in a register in the RAM 13 and these filter coefficient data ACF(0)–ACF(15) are supplied to the digital filter 23 in the tone signal generation circuit 22. Instead of the processings of steps 61 and 62, the same processings as steps 59 and 60 may be executed.

The mode "1" is advantageous over the mode "0", for the operation for calculating the coefficient difference value data DCF(0–DCF(15) is unnecessary and so accessing of data can be made more quickly in the mode "1". The mode "1" requires an extra memory for storing the coefficient difference value data but this memory can be of a small bit number and therefore of a small capacity because the coefficient difference value data itself is a small value.

The coefficient difference value data for the mode "1" are respectively stored in the frame banks in the above described embodiment. Alternatively, the addresses may be stored in the frame banks and the coefficient difference value data may be stored in the parameter bank 20*c*.

In the above described embodiment, the interpolation operation is executed by the software processings. Alternatively, the interpolation operation may be executed by a hardware circuit provided exclusively for that purpose.

In the above described embodiment, switching of the time frame is made in response to the output of the timer counter and therefore is unrelated to the tone pitch. Alternatively, the switching of the timer frame (and also interpolation timing) may be controlled in association with the phase address signal of a tone to be processed.

In the above described embodiment, the switching of the respective frames is made in a predetermined order but it may be made at random.

The manner of interpolation operation of the filter coefficients is not limited to the one employed in the above embodiment but any other method may be employed. The interpolation need not be linear interpolation but may be of any desired interpolation characteristics. For example, the interpolation may be one made through a digital low-pass filter. Alternatively, for example, an initial value of a filter coefficient may be stored for the frame 1 and difference in filter coefficients between adjacent frames may be stored for subsequent frames and this difference data may be shifted to obtain the coefficient difference value data.

This invention is, applicable not only to monophonic musical instruments but also to polyphonic musical instruments. The keyboard and the tone source circuit may be provided as a separate unit from the tone signal processing device according to the invention.

Figure 10:
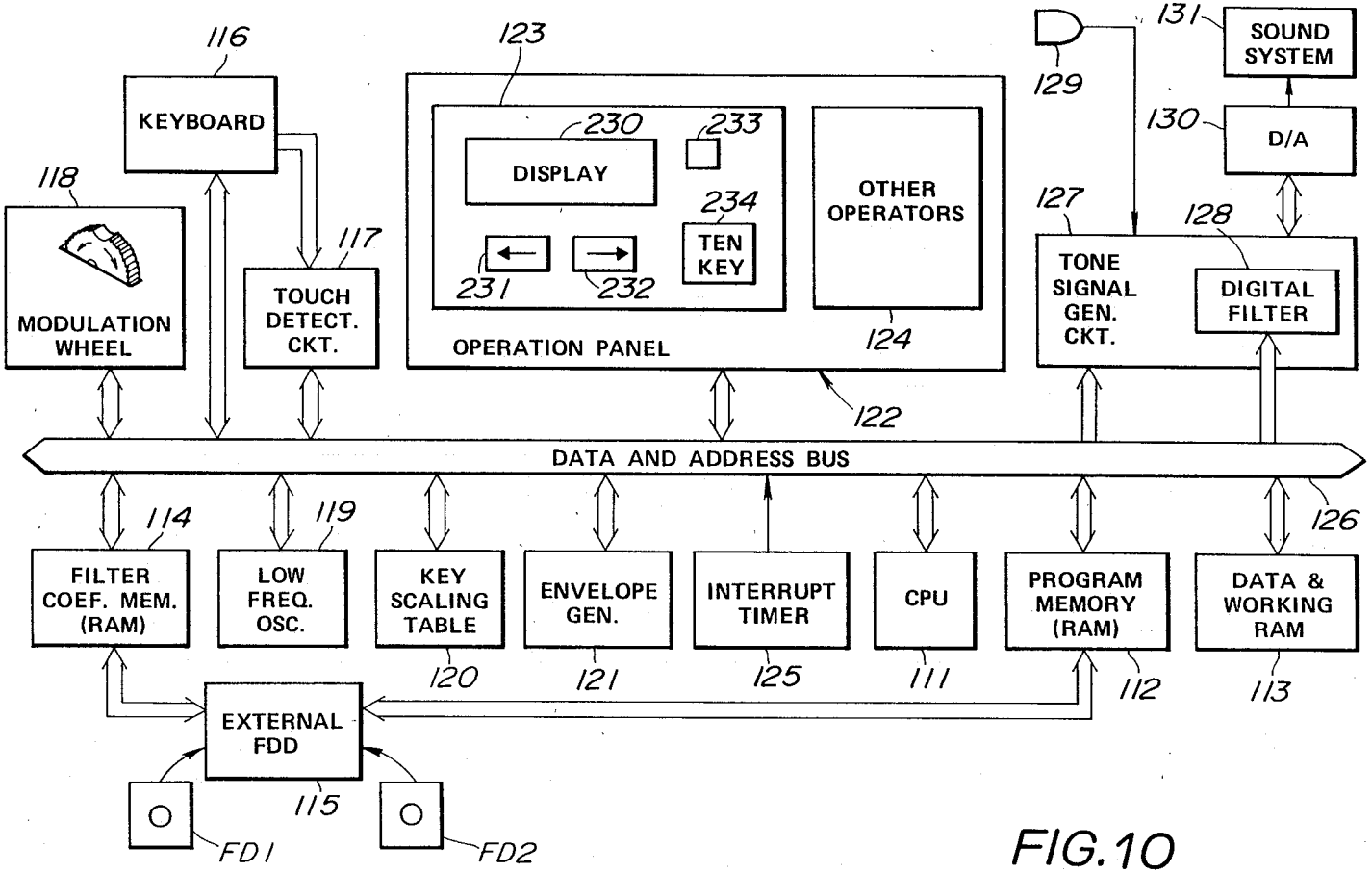
FIG. 10 is a block diagram showing a hardware construction of another embodiment of an electronic musical instrument incorporating the device according to the invention.

Referring now to FIG. 10 and subsequent figures, another embodiment of the invention will be described.

FIG. 10 shows a hardware construction of an embodiment of an electronic musical instrument incorporating the invention. In the electronic musical instrument of this embodiment, various operations and processings including reading of filter coefficients and filter coefficient interpolation operation are controlled by a microcomputer section comprising a CPU 111, program memory 112 and data and working RAM 113. The program memory 112 consists of a RAM in which a specification of a control program stored therein can be readily changed by rewriting the control program.

Figures 11, 12A, 12B, 12C, 12D, 12E:
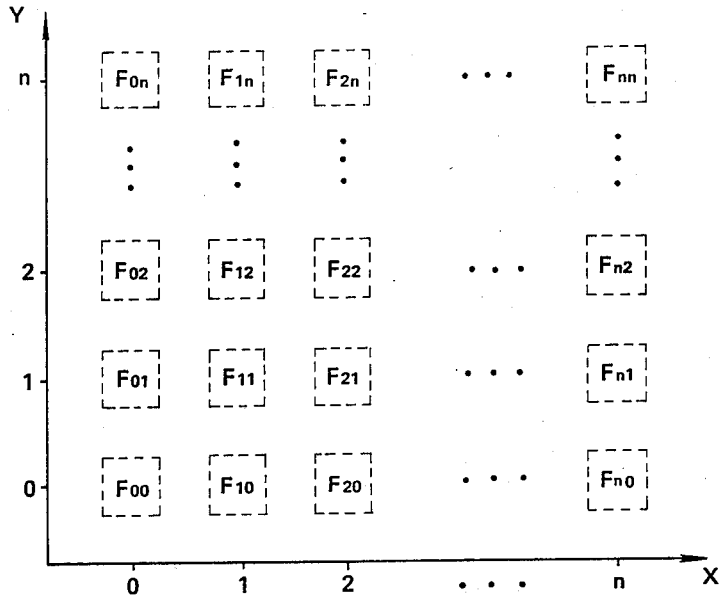
FIG. 11 is a graph showing an example of coordinate data assigned to respective sets of filter coefficients in one filter coefficient table in a filter coefficient memory in FIG. 10.
FIGS. 12*a–e* are diagrams showing an example of display in a filter relating operation panel in FIG. 10.

A filter coefficient memory 114 stores plural sets of filter coefficients realizing desired filter characteristics, each of these sets being assigned with biaxial coordinate data as address data. More specifically, for example, the filter coefficient memory 114 comprises tables each of which stores plural sets of filter coefficients. Coordinate data having axes X and Y is assigned as address data to each set of filter coefficients in the respective tables. An example of memory, format of filter coefficients in one table is schematically shown in FIG. 11. In this figure, coordinate positions of axis X are $n+1$ points of 0, 1, 2, . . . n and coordinate positions of axis Y are likewise $n+1$ points of 0, 1, 2, . . . n. Filter coefficients F00–Fnn of $(n+1)^2$ sets are assigned to $(n+1)^2$ addresses identified by crossing points of the respective coordinate positions. One set of filter coefficients realizes one desired filter characteristics and consists of filter coefficients of plural orders.

The filter coefficient memory 114 consists of a RAM in which contents of filter coefficients stored can be rewritten. An external magnetic disc drive unit 115 is attached to the electronic musical instrument and a flexible magnetic disc cartridge (floppy disc) FD1 storing multiple sets of filter coefficients is set in this disc drive unit 115 so that the sets of filter coefficients can be transferred to the filter coefficient memory 114 and stored therein. Further, a floppy disc FD2 (i.e., system disc) storing a control program is set in the disc drive unit 115 so that the control program stored therein can be transferred to the program memory 112 and stored therein.

A keyboard 116 has plural keys for designating tone pitches of tones to be generated. A touch detection circuit 117 detects touch of a key depressed in the keyboard 116. Kinds of touches to be detected may be either an initial touch or an after touch. Key touch data detected by this touch detection circuit 117 is utilized for controlling tone elements such as tone color, tone volume and tone pitch. If the key touch data is utilized as tone color control information, it is used for controlling filter coefficient and thereby modifying characteristics of a digital filter.

A modulation wheel 118 is a manual operation means for generating tone color control information and this tone color control information is used for controlling filter coefficients.

A low frequency oscillator 119 generates a low frequency signal as a modulating signal for filter coefficients.

A key scaling table 120 generates key scaling data corresponding to the tone pitch of a tone to be generated. This key scaling data is used as tone color control information for controlling filter coefficients.

A filter envelope generator 121 generates envelope shape data having characteristics such as attack, decay, sustain and release in response to depression of a key. This envelope shape data is used as tone color control information for controlling filter coefficients.

An operation panel section 122 comprises an operation panel 123 relating to a filter and other various tone determination and control switches and operators 124. By way of example, the filter relating operation panel 123 comprises a display 230, cursor switches 231 and 232, a filter edit switch 233 and a ten key switch 234 and is used for performing operations relating to selection and determination of filter coefficients.

An interrupt timer 125 is provided for determining loading of various set data and basic timing of the filter coefficient interpolation operation and supplies an interrupt signal to the microcomputer section at a predetermined interval (e.g., every 10 ms).

A tone signal generation circuit 127 generates a digital tone signal having a tone pitch corresponding to a depressed key in response to data of the depressed key (i.e., key code and key-on signal) supplied through a data and address bus 126, and supplies this digital tone signal to a digital filter 128 to apply a tone color control in accordance with filter characteristics of this digital filter 128. As a method for generating a tone signal, any type of tone signal generation method may be utilized as described in the previous embodiment. In case the memory reading method is employed as the tone signal generation method, an external sound may be freely sampled through a microphone 129 and the sampled external sound waveshape data may be read out from a waveshape memory to generate a digital tone signal.

The digital filter 128 receives, as in the digital filter shown in FIG. 2, the digital tone signal and filter coefficients and controls the input tone signal in accordance with filter characteristics determined by the filter coefficients. As previously described, the digital filter may be of any type. An FIR filter of 32 orders as shown in FIG. 3 is advantageous in designability, stability and suitability for tone control. The following description will be made on the assumption that this FIR filter is used as the digital filter in the present embodiment. In the previously described embodiment, filter coefficients of all orders N (=32) are not prepared since filter coefficients of an order at symmetrical positions are of the same value but sixteen filter coefficients from the zero-th to the fifteenth orders are prepared, filter coefficients from the sixteenth to the thirty-first orders being substituted by filter coefficients from the zero-th to the fifteenth order at symmetrical positions. In the present embodiment, however, description will be made on the assumption that all filter coefficients from the zero-th to the thirty-first orders are prepared. The FIR filter has an additional advantage owing to its excellent stability that even in a case where filter coefficients are densely produced by interpolation, filter characteristics corresponding to the filter coefficients produced by the interpolation can be obtained without distortion.

The digital tone signal produced by the tone signal generation circuit 127 is converted to an analog signal by a digital-to-analog converter 130 and is applied to a sound system 131.

An outline of an example of selection and determination of filter coefficients by using the operation panel 127 will be described.

Upon turning on of the filter edit switch 233, the display 230 displays a filter edit menu whose contents are as shown in FIG. 12*a*. The user selects a desired one of edit modes 1–4 by operation of the ten key switch 234.

If a parameter set mode (Parameter) of No. 1 has been selected, the picture of the display 230 changes to one shown by FIG. 12*b*. In this mode, condition for reading out filter coefficients for determining characteristics of the digital filter from the filter coefficient memory 114 and conditions for variably controlling these filter coefficients are established. A desired one of items "tbl", "Dyn-axis", "dyn" and "fix" on the upper stage of the display 230 is selected and desired data corresponding to the selected item is selected and determined by operation of the ten key switch 234. In the lower stage of the items "tbl", "Dyn-axis", "dyn" and "fix" in the display 230 is displayed data selected and determined in accordance with the selected item. These items will now be described.

tbl: A filter coefficient table in the filter coefficient memory 114 is selected. Data selected here is registered as filter coefficient table data FTABLE in a register in the data and working RAM 113 (see FIG. 14).

Dyn-axis: Which of X and Y coordinate data in the filter coefficient table (see FIG. 11) should be variably controlled in response to the tone color control information is selected. The coordinate axis which is variably controlled in response to the tone color control information will hereinafter be referred to as "dynamic axis". If, for example, the axis X is to be determined as the dynamic axis, "0" is applied by the ten key switch 234 whereas if the axis Y is to be determined as the dynamic axis, "1" is applied by the ten key switch 234. The data determined here is registered as dynamic axis data DYNAXS in a register in the data and working RAM 113 (see FIG. 14).

dyn: The coordinate data of the dynamic axis is designated. The data designated here is registered as dynamic axis reference coordinate data DYN in a register in the data and working RAM 113 (see FIG. 14).

fix: The coordinate data of the axis which is not the dynamic axis (hereinafter referred to as "fixed axis") is designated. The data designated here is registered as fixed axis coordinate data FIX in a register in the data and working RAM 113 (see FIG. 14).

Designation of the dynamic axis coordinate data and fixed axis coordinate data is effected by applying desired coordinate values by the ten key switch 234. As described previously with reference to FIG. 11, the sets of filter coefficients stored in the respective tables in the filter coefficient memory 114 are assigned with the coordinate data of X and Y axes and one set of filter coefficients is identified by combination the dynamic axis coordinate data and the fixed axis coordinate data designated in the items dyn and fix. If values of coordinate data assigned to the respective sets of filter coefficients are integers, values of the dynamic axis coordinate data and the fixed axis coordinate data which can be designated here are not limited to integers but they may contain decimals. If the designated coordinate data contains decimal, a filter coefficient directly corresponding to this data is not stored in the filter coefficient memory 114 so that the filter coefficient is obtained by interpolation.

More specifically, if, for example, designated coordinate data consists of an integer section only as in (1, 1), the designated filter coefficients can be obtained without performing interpolation by reading out a set of filter coefficients F11 corresponding to this coordinate (1, 1) as shown in FIG. 13. If, however, the designated coordinate data contains a decimal section as in (1, 1.5), a set of filter coefficients F11 corresponding to coordinate (1, 1) and another set of filter coefficients corresponding to coordinate (1, 2) are read out from the filter coefficient memory 114 as shown in FIG. 13 and interpolation is performed between the respective coordinates at a ratio corresponding to decimal values (0, 0.5) of the respective coordinates to obtain a set of filter coefficients which are actually not stored in the filter coefficient memory 114.

Reverting to FIG. 12*a*, if an envelope select mode (Envelope) of No. 2 has been selected, the picture of the display 230 changes as shown in FIG. 12*c*. In this mode, various conditions for forming an envelope shape for variably controlling filter coefficients are determined. A desired item among items "R1", "R2", "R3", "R4", "L1", "L2", "L3" and "L4" of the upper stage of the display 230 is selected by operation of the cursor switches 231 and 232 and desired data corresponding to the selected item is determined by the ten key switch 234. In the lower stage of the items "R1", "R2", "R3", "R4", "L1", "L2", "L3" and "L4" is displayed data which has been determined in correspondence to the selected item. These items will now be described.

In association with attack, decay, sustain and release which are elements of a normally known envelope shape, "R1" determines an attack rate, "R2" a decay rate, "R3" a sustain rate, "R4" a release rate, "L1" an attack level, "L2" a decay level, "L3" a sustain level and "L4" a release level respectively. Data of the respective items R1–L4 are registered as filter envelope determining data FENV(0)–FENV(7) in a register in the data and working RAM 113 (see FIG. 14). The filter envelope generator 121 in FIG. 10 generates, upon generation of the key, envelope shape data in accordance with the filter envelope determining data FENV(0)–FENV(7).

Reverting to FIG. 12(*a*), if a low frequency modulating signal set mode (Lfo) of No. 3 has been selected, the picture of the display 230 changes as shown in FIG. 12*d*. In this mode, various conditions of a low frequency modulating signal generated by the low frequency oscillator 119 are determined. A desired one among items "wave", "speed", "delay" and "depth" in the upper stage of the display 230 is selected by operation of the cursor switches 231 and 232 and desired data corresponding to the selected item is selected and determined by the ten key switch 234. In the lower stage of the items "wave", "speed", "delay" and "depth"is displayed data determined in correspondence to the selected item.

wave: A waveshape of the low frequency modulating signal generated by the low frequency oscillator 119 is selected. For example, a desired waveshape is selected from among sinusoidal wave, triangular wave, saw-tooth wave, inverted saw-tooth wave and square wave. Data selected here is registered as low frequency wave-shape data WAVE in a register in the data and working RAM 113 (see FIG. 14).

speed: Speed (frequency) of the low frequency modulating signal generated by the low frequency oscillator 119 is determined. Data determined here is registered as low frequency speed data SPEED in a register in the data and working RAM 113 (see FIG. 14).

delay: Delay time from start of depression of the key to start of oscillation of the low frequency oscillator 119 is determined. Data determined here is registered as low frequency oscillation delay time data DELAY in a register in the data and working RAM 113 (see FIG. 14).

depth: Amplitude (i.e., modulation factor or depth) of the low frequency modulating signal generated by the low frequency oscillator 119 is determined. Data determined here is registered as low frequency amplitude data DEPTH in a register in the data and working RAM 113 (see FIG. 14).

The low frequency oscillator 119 generates the low frequency modulating signal in accordance with these data WAVE - DEPTH.

Reverting to FIG. 12*a*, if a key scaling mode (Scale) of No. 4 has been selected, the picture of the display 230 changes as shown in FIG. 12*e*. In this mode, a desired one of plural key scaling curves in the key scaling table 120 is selected. Data selected here is registered as key scaling curve select data KYSCV in a register in the data and working RAM 113 (see FIG. 14). A key scaling curve corresponding to this key scaling curve select data KYSCV can now be read out selectively from the key scaling table 120 and key scaling data corresponding to tone pitch (or tone range) of a depressed key in this key scaling curve is read out from the table 120.

An example of a flow chart of processings relating to this invention among processings executed by the microcomputer section is shown in FIGS. 15–18. An example of contents stored in the data and working RAM 113 used in association with these processings is shown in FIG. 14.

KCODE represents key code which represents a key depressed in the keyboard 116 (FIG. 10).

TDATA represents touch data which represents a key touch which has been detected by the touch detection circuit 117 (FIG. 10).

WHEELD represents modulation wheel data which corresponds to the amount of operation of the modulation wheel 118 (FIG. 10).

The data FTABLE - KYSCV have been described before.

EGDATA represents envelope shape data and shows present value of envelope shape data used for controlling filter coefficients generated by the filter envelope generator 121 (FIG. 10).

LFODAT represents low frequency modulating signal data and shows present value of the low frequency modulating signal generated by the low frequency oscillator 119 (FIG. 10).

KYSDAT represents key scaling data and shows present value of key scaling data read out from the key scaling table 120 (FIG. 10) in accordance with the tone pitch (or tone range) of the depressed key.

DYNDAT represents dynamic axis coordinate data and shows present value of the dynamic axis.

XAXIS represents X axis coordinate data and shows present coordinate value.

YAXIS represents Y axis coordinate data and shows present coordinate value.

One of the X axis and Y axis coordinate data XAXIS and YAXIS corresponding to the dynamic axis is of the same contents as the dynamic axis coordinate data DYNDAT and the other of the X axis and Y axis coordinate data XAXIS and YAXIS is of the same contents as the fixed axis coordinate data FIX.

By combination of the X axis coordinate data XAXIS and the Y axis coordinate data YAXIS, filter coefficients to be read out from the filter coefficient memory 114 are specified. In this case, one of the coordinate data XAXIS and YAXIS is the same as the fixed axis coordinate data FIX and this data is designated by the processing in the parameter set mode (see FIG. 12(*b*)) using the operation panel 123. On the other hand, the other of the coordinate data XAXIS and YAXIS corresponding to the dynamic axis coordinate data DYNDAT is one which is modified by various tone color control information as described below.

An operation is made for modulating the dynamic axis reference coordinate data DYN designated as desired by operation of the operation panel 123 with touch data TDATA, modulation wheel data WHEELD, envelope shape data EGDATA, low frequency modulating signal data LFODAT and key scaling data KYSDAT and result of the modulating operation is used as the dynamic axis coordinate data DYNDAT. The data TDATA, WHEELD, EGDATA, LFODAT and KYSTAT may contain a decimal section and the dynamic axis coordinate data DYNDAT obtained by the modulating operation may also contain a decimal section. As described above, in the filter coefficient memory 114, a filter coefficient which directly, corresponds to coordinate values containing a decimal section is not assigned and in this case a filter coefficient corresponding to a coordinate value containing a decimal section is obtained by performing an interpolation operation. The operation for modulating or modifying the dynamic axis reference coordinate data DYN with the data TDATA, WHEELD, EGDATA, LFODAT and KYSDAT used as tone color control information may be any arithmetic operation such as addition, subtraction, multiplication and division. For example, addition and subtraction may be used.

COEFA and COEFB are interpolation operation coefficient registers which store two filter coefficients which are to be subjected to the interpolation operation. The interpolation operation is effected between coefficients of the same order in filter coefficients of two sets which are to be subjected to the interpolation operation. The registers COEFA and COEFB store filter coefficients of the order which are presently to be subjected to the interpolation operation.

COEFD(0)–COEFD(31) are filter coefficient registers which store filter coefficient data of the respective orders (from the zero-th to the thirty-first) which have been finally obtained by reading from the filter coefficient memory 114 and the interpolation operation. The filter coefficient data of the respective orders stored in the filter coefficient registers COEFD(0)–COEFD(31) are supplied to the digital filter 128 to determine the characteristics of this filter.

Figure 15:
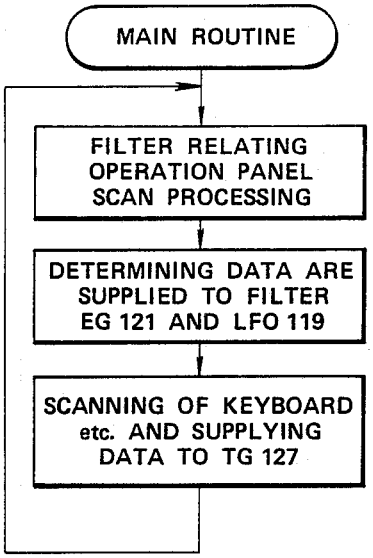

FIG. 15 shows a main routine. In "filter relating operation panel scan processing", on-off detection scanning of switches of the filter relating operation panel 123 is performed and, in accordance with result of this scanning, the processings relating to selection and determination of filter coefficients as described already with reference to FIG. 12 are performed to register the data FTABLE, DYNAXS, DYN, FIX, FENV(0)–FENV(7), WAVE, SPEED, DELAY, DEPTH and KYSCV in the registers of the data and working RAM 113.

In a next processing, data WAVE, SPEED, DELAY and DEPTH for determining the low frequency modulating signal registered in the data and working RAM 113 are supplied to the low frequency oscillator 119 (abbreviated as LFO in the figure) and the filter envelope determining data FENV(0)–FENV(7) are supplied to the filter envelope generator 121 (abbreviated as filter EG in the figure).

In a next processing, on-off detection scanning of the keyboard 116 and other operators 124 is performed and data obtained as a result of this scanning which are necessary for forming a tone are supplied to the tone signal generation circuit 127 (abbreviated as TG in the figure).

Figure 16:
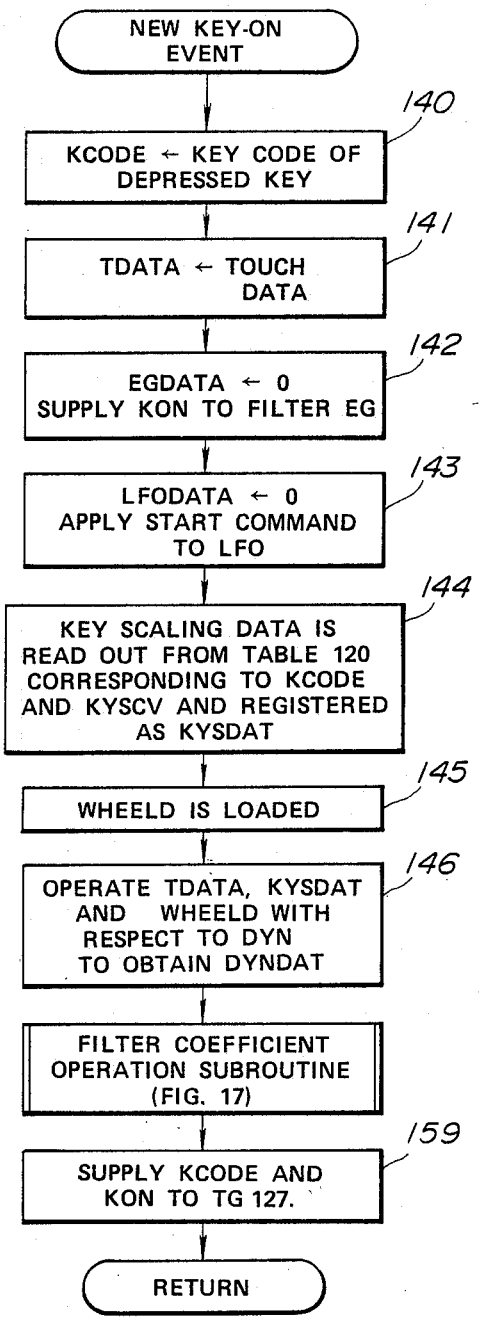

When depression of a new key has been detected during the on-off detection scanning concerning the respective keys, "new key-on event routine" shown in FIG. 16 is executed. For brevity of explanation, in the embodiment shown in FIG. 16, the program has been made on the assumption that the tone corresponding to the newly depressed key is sounded in a single tone preference system.

Figure 18:
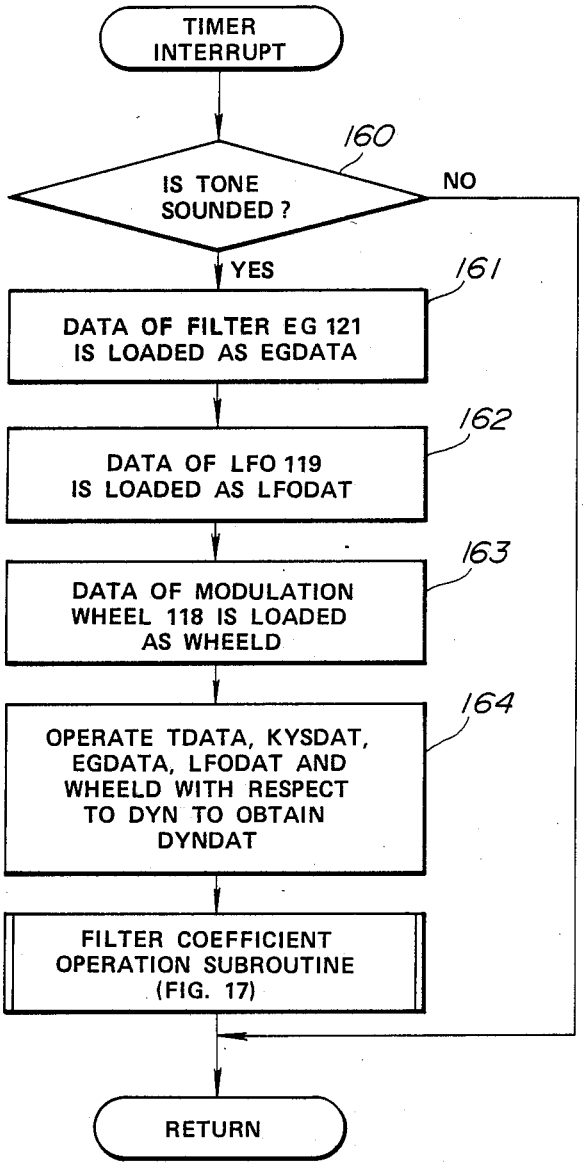

On the way the main routine is executed, "timer interrupt routine" shown in FIG. 18 is executed regularly each time an interrupt signal is provided from the interrupt timer 125.

In the "new key-on event routine" shown in FIG. 16, key code of the newly depressed key is registered as KCODE (step 140). Then, key touch data which has been detected by the touch detection circuit 117 in response to depression of the newly depressed key is registered as TDATA (step 141).

In next step 142, initial value "0" is set as the envelope shape data EGDATA and signal "1" representing that there is a depressed key is supplied as key-on signal KON to the envelope generator 121. The initial value of the envelope shape data EGDATA is not limited to "0" but may be any other value. Upon receipt of "1" as the key-on signal, the envelope generator 121 starts generation of envelope shape data.

In next step 143, an initial value "0" is set as the low frequency modulating signal data LFODAT and a start command is applied to the low frequency oscillator 119. In response to this start command, the low frequency oscillator 119 starts oscillation. However, actual oscillation is started upon lapse of the delay time determined by the above described data DELAY.

In next step 144, a key scaling curve corresponding to the key scaling curve select data KYSCV is selected in the key scaling table 120 and key scaling data corresponding to the tone pitch of key code KCODE in this selected key scaling curve is read out from the key scaling table 120. The read out key scaling data is registered as KYSDAT.

In next step 145, output of operation of the modulation wheel 118 is loaded and registered as the modulation wheel data WHEELD.

In next step 146, the touch data TDATA, modulation wheel data WHEELD and key scaling data KYSDAT are operated with respect to the dynamic axis reference coordinate data DYN and the coordinate data DYN is variably controlled by these data and results of operation are registered as dynamic axis coordinate data DYNDAT. In this case, envelope shape data EGDATA and low frequency modulating signal data LFODAT are not included in the operation because initial values of these data have been made "0". If the initial values of these data are not "0", these data may be included in the operation. Nextly, "filter coefficient operation subroutine" is executed.

Figure 17:
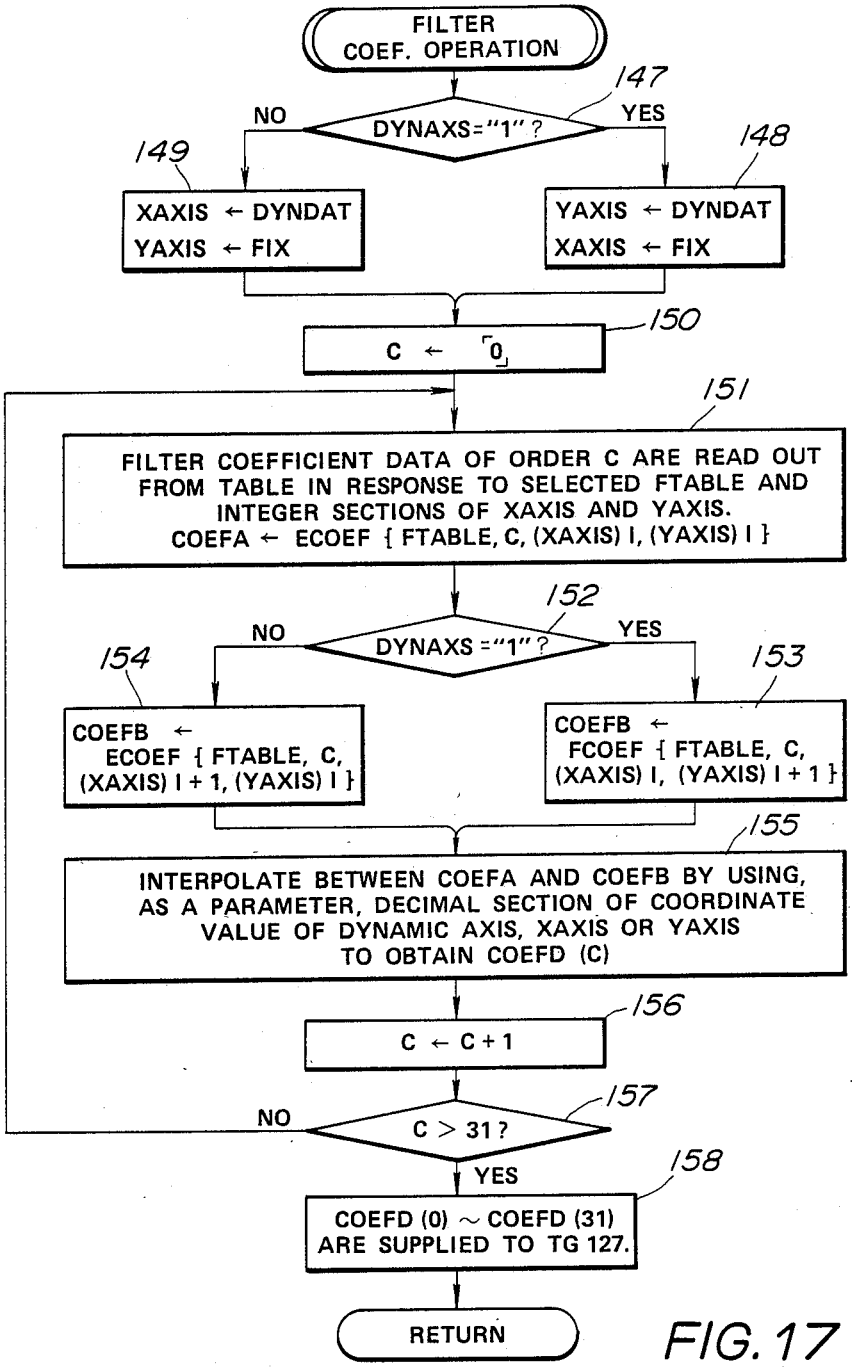

An example of "filter coefficient operation subroutine" is shown in FIG. 17. In this processing, whether the dynamic axis data DYNAXS is "1" or not is examined (step 147). If it is "1", the dynamic axis is Y axis and the processing proceeds to step 148. In step 148, the dynamic axis coordinate data DYNDAT which has been obtained in the preceding step 146 is registered as the Y axis coordinate data YAXIS and the fixed axis coordinate data FIX which has been designated in the above described "filter relating operation panel scan processing" is registered as the X axis coordinate data XAXIS.

In next step 150, contents of an order register C are set to "0". The contents of the order register C indicate the order of filter coefficients which are to be obtained presently by operation.

In next step 151, one of the filter coefficient tables in the filter coefficient memory 114 designated by filter coefficient table data FTABLE which has been determined in the above described "filter relating operation panel scan processing" is selected and a set of filter coefficients corresponding to X and Y coordinate values designated by integer sections of the X axis coordinate data XAXIS and the Y axis coordinate data YAXIS in the selected table are specified and filter coefficient among the set of filter coefficients of the order designated by the order register C is read out. The filter coefficient of a certain order thus read out is designated by FCOEF {FTABLE, C, (XAXIS)I, (YAXIS)I}. The filter coefficient of a certain order thus read out is stored in one interpolation operation coefficient register COEFA.

In next step 152, as in step 147, whether the dynamic axis data DYNAXS is "1" or not is examined. If the result is "1", the processing proceeds to step 153 whereas if the result is "0", the processing proceeds to step 154.

In step 153, in the filter coefficient table designated by the data FTABLE, a set of filter coefficients is specified by the integer section (XAXIS)I of the X axis coordinate data XAXIS and a Y axis coordinate value (YAXIS)I+1 which is larger than the integer section (YAXIS)I of the Y axis coordinate data YAXIS by 1 and filter coefficient among this set of filter coefficients which is of the order designated by the order register C is read out. The filter coefficient of a certain order thus read out is designated by ECOEF {FTABLE, C, (XAXIS)I, (YAXIS)+1} in the figure. The filter coefficient of a certain order thus read out is stored in the other interpolation operation coefficient register COEFB. In this case, since the Y axis is the dynamic axis, interpolation along the Y axis is performed.

In step 154, in the filter coefficient table designated by the data FTABLE, a set of filter coefficients is specified by an X axis coordinate value (XAXIS)I+1 which is larger than the integer section (XAXIS)I of the X axis coordinate data XAXIS by 1 and the integer section (YAXIS)I of the Y axis coordinate data YAXIS and filter coefficient among this set of filter coefficients which is of the order designated by the order register C is read out. The filter coefficient thus read out is designated by ECOEF {EFABLE, C, (XAXIS)I+1, YAXIS)I} in the figure. The filter coefficient of a certain order thus read out is stored in the other interpolation operation coefficient register COEFB. In this case, since the X axis is the dynamic axis, interpolation along the X axis is performed.

In next step 155, an operation for interpolating between the filter coefficients stored in the registers COEFA and COEFB is performed by using, as a parameter, a decimal section of coordinate value corresponding to the dynamic axis in the X axis coordinate data XAXIS and the Y axis coordinate data YAXIS. The filter coefficient obtained by this interpolation operation is registered in the filter coefficient register COEFD(C) (one of COEFD(0)–COEFD(31)) corresponding to the order designated by the order register C. The function of this interpolation operation may be linear interpolation or other suitable curve (e.g., secondary curve or any interpolation curve prestored in an interpolation function memory).

Then, the contents of the order register are increased by 1 (step 156) and whether this value is larger than the maximum order 31 or not is examined (step 157). If the value has not exceeded the order 31, the processing returns to step 151 and the same processing as described above is repeated with respect to the next order. By repeating steps 151–157, filter coefficients of all orders have been completed and step 157 becomes YES. Then the processing proceeds to step 158.

In step 158, filter coefficient data of all orders stored in the filter coefficient registers COEFD(0)–COEFD(31) are supplied to the digital filter 128.

Reverting to FIG. 16, upon completion of the filter coefficient operation subroutine, the processing proceeds to step 159 in which key code KCODE and key-on signal KON of a newly depressed key are supplied to the tone signal generation circuit 127.

Description will be made about "timer interrupt routine" shown in FIG. 18. Firstly, whether sounding of a tone is presently made or not is examined in step 160. If a tone is being sounded, the processing proceeds to step 161. If no tone is being sounded, the processing proceeds to "return".

In step 161, envelope shape data which is being produced by the filter envelope generator 121 is loaded and registered as EGDATA.

In next step 162, the low frequency modulating signal data which is being produced by the low frequency oscillator 119 is loaded and registered as LFODAT.

In next step 163, as in the above described step 145, output of operation of the modulation wheel 118 is loaded and registered as the modulation wheel data WHEELD.

In next step 164, the touch data TDATA, modulation wheel data WHEELD, envelope shape data EGDATA, low frequency modulating signal data LOFDAT and key scaling data KYSDAT are operated with respect to the dynamic axis reference coordinate data DYN to variably control the coordinate data DYN and results of the operation are registered as the dynamic axis coordinate data DYNDAT.

Then, "filter coefficient operation subroutine" in FIG. 17 is executed to produce filter coefficient data by interpolation operation and the filter coefficient data obtained are supplied to the digital filter 128.

Assuming that a filter coefficient table as shown in FIG. 13 has been selected, an example of selection of filter coefficients and interpolation operation will be described. In FIG. 13, for facilitating understanding, filter characteristics curves realized by sets of filter coefficients are schematically shown at coordinate positions of the respective filter coefficients sets F00–F22. In these filter characteristics curve, horizontal axis f represents frequency and vertical axis L represents level.

Let us now assume that the dynamic axis data DYNAXS is "1" (assuming that the Y axis is the dynamic axis), dynamic axis reference coordinate data DYN is set at "0" and the fixed axis coordinate data FIX is set at "2". In this case, "2" corresponding to the fixed axis coordinate data is initially designated as the X axis coordinate data and "0" corresponding to the dynamic axis reference coordinate data DYN is initially designated as the Y axis coordinate data. By this designation, the filter coefficient set F20 assigned to the Y, Y coordinate positions (2, 0) is selected.

If an operation for modulating the dynamic axis reference coordinate data DYN is performed by using the touch data TDATA, modulation wheel data WHEELD, envelope shape data EGDATA, low frequency modulating signal data LFODAT and key scaling data KYSDAT which are tone color control information and the dynamic axis coordinate data DYNDAT obtained as a result of this operation is for example "0.3", the Y axis coordinate data YAXIS is changed to "0.3". However, the integer section (YAXIS)I of the Y axis coordinate data YAXIS is "0" and remains unchanged and the filter coefficient set selected from the filter coefficient table still is F20 assigned to the X, Y coordinate positions (2, 0) and remains unchanged from the initially set one. However, an interpolation operation is performed between the filter coefficient sets F20 and F21 by using decimal section "0.3" of the Y axis coordinate data YAXIS as a parameter.

More specifically, filter coefficients of the filter coefficient set F20 assigned to the X, Y coordinate positions (2, 0) is stored in the register COEFA whereas filter coefficients of the filter coefficient set F21 assigned to X, Y coordinate positions (2, 1) specified by the Y axis coordinate data (YAXIS)I+1="1" which is larger than the integer section (YAXIS) of the Y axis coordinate data YAXIS by 1 and the X axis coordinate data XAXIS which is "2" is selected from the filter coefficient table and stored in the register COEFB. Thus, the interpolation operation is performed between the filter coefficients stored in the registers COEFA and COEFB by using the decimal section "0.3" of the Y axis coordinate data YAXIS as a parameter. The filter characteristics realized by the filter coefficients prepared by the interpolation operation are synthesized characteristics obtained by interpolating, at a ratio corresponding to the decimal section "0.3" of the Y axis coordinate data YAXIS, the two filter characteristics corresponding to the filter coefficient sets F20 and F21 which have been subjected to the interpolation. If, for example, the filter coefficient set F20 realizes low-pass filter characteristics and F21 realizes high-pass filter characteristics, the filter characteristics can be variably controlled in accordance with, a magnitude of composite value of the data TDATA, WHEELD, EGDATA, LFODAT and KYSDAT which are tone color control information over a range from filter characteristics which are close to the low-pass filter characteristics of F20 to filter characteristics which are close to the high-pass filter characteristics of F21.

As described above, in a case where the filter coefficient set F20 assigned to the X, Y coordinate positions (2, 0) has been initially designated and an operation is performed for modulating the dynamic axis reference coordinate data DYN by a composite value of the data TDATA, WHEELD, EGDATA, LFODAT and KYSDAT which are tone color control information, if the dynamic axis coordinate data DYNDAT, obtained as a result of the operation has changed to the integer section as in "1.2", the Y axis coordinate data YAXIS is changed to "1.2" and, accordingly, the integer section (YAXIS)I of the Y axis coordinate data YAXIS is changed to "1" so that the filter coefficient set selected from the filter coefficient table is changed to the set F21 assigned to the X, Y coordinate (2, 1). The filter coefficients of this filter coefficient set F21 are read out from the filter coefficient table and stored in the register COEFA. This change is accompanied by reading from the filter coefficient table and storing in the register COEFB of a filter coefficient set F22 assigned to Y, Y coordinate positions (2, 2) specified by Y axis coordinate value (YAXIS)I+1="2" which is larger than the integer section (YAXIS)I of the Y axis coordinate data YAXIS by 1 and the X axis coordinate data XAXIS which is "2". Thus, the filter characteristics realized by filter coefficients prepared by the interpolation operation are synthetic filter characteristics obtained by interpolating, at a ratio corresponding to the decimal section "0.2" of the Y axis coordinate data YAXIS, the two filter characteristics corresponding to the filter coefficient sets F21 and F22. If the filter coefficient set F21 realizes high-pass filter characteristics and the filter coefficient set F22 realizes low-pass filter characteristics, the filter characteristics can be variably controlled in accordance with magnitude of a composite value of the data TDATA, WHEELD, EGDATA, LFODAT and KYSDAT which are tone color control information over a range from high-pass filter characteristics of a relatively low cut-off frequency corresponding to the set F21 to high-pass filter characteristics of a relatively high cut-off frequency corresponding to the set F22.

In steps 152, 153 and 154 in FIG. 17, the coordinate value of axis corresponding to the dynamic axis is increased by 1 whereas the coordinate value of axis corresponding to the fixed axis is not increased by 1 and filter coefficient at corresponding coordinate is stored in the register COEFB. Alternatively, the coordinate values of the X and Y axes may be respectively increased by 1 and filter coefficient at corresponding coordinate may be stored in the register COEFB. In other words, filter coefficient of a certain order represented by FCOEF {FTABLE, C, (XAXIS)I+1, (YAXIS)I+1} may be stored in the interpolation operation coefficient register COEFB. In this case, by setting data containing a decimal section as the fixed axis coordinate data FIX during "filter relating operation panel scan processing", filter coefficient along the fixed axis corresponding to the decimal section can be interpolated.

In the above described embodiment, a coordinate axis (dynamic axis) which is controlled in accordance with the tone color control information is only one axis. The X and Y axes may however be both dynamic axes. If so, in a case where coordinate data of both axes are simultaneously variably controlled, the shifting direction of filter coefficient to be selected on the coordinate of the filter coefficient table need not extend along only one axis but may be freely set such, for example, as obliquely or drawing circle on the coordinate plane.

In the above described embodiment, the dynamic axis is common to any tone color control elements such as key touch, key scaling and envelope shape. The dynamic axis may however be selected independently from each other tone color control element. In this case, the synthesizing operation of corresponding tone color control information and coordinate data changing operation corresponding thereto should be performed with respect to X axis and Y axis selected as the dynamic axis for each of the tone color control elements. By this arrangement, further complex filter control can be realized.

In the above described embodiment, the filter coefficient table can be selected as desired by the user. Alternatively, a suitable filter coefficient may be automatically selected in accordance with tone color selection operation. Further, in the above described embodiment, selection of the dynamic axis and determination of dynamic axis coordinate data and fixed axis coordinate data are made as desired by the user so that designation of the X and Y coordinate data can be made as desired by the user. Alternatively, an arrangement may be made so that suitable data can be automatically selected in accordance with a suitable operation such as tone color selection operation.

In the embodiment of FIG. 10, the interpolation operation etc. are executed by the software processings. These operations may be realized by a hardware circuit provided exclusively for that purpose.

In the above described embodiment, the low frequency oscillator 119 and the filter envelope generator 121 are constructed of hardware circuits provided exclusively for these purposes. These circuits may however be realized by software processings.

In the above described embodiments, generation of key scaling data is effected by reading out the data from the key scaling table 120. Alternatively, key scaling data corresponding to a depressed key may be generated by performing a predetermined operation in accordance with the key code.

In the embodiment of FIG. 10 also, the invention is applicable not only to monophonic musical instruments but to polyphonic musical instruments. In the latter case, the envelope generator 121 should generate envelope shape data for each of tone generation channels.

In the embodiment of FIG. 10 also, the keyboard 116 and the touch detection circuit 117 may be provided as a separate unit from a unit incorporating a tone signal processing device. In this case, data is transmitted according to MIDI standard. Further, the present invention is applicable not only to tone signal processing of scale notes but also to signal processing of rhythm sounds and other sounds.

In the above described embodiment, coordinate axes in the filter coefficient table consist of two axes (i.e., two dimensional coordinate). The coordinate axes may however consist of three axes (i.e., three dimensional coordinate) or one axis (i.e., one dimensional coordinate).

From the standpoint that coordinate data of a filter coefficient to be read out is changed by variably controlling coordinate data of at least one coordinate axis in accordance with tone color control information and a set of filter coefficients to be read out from the filter coefficient memory is thereby changed, it is not essential to perform interpolation operation. If interpolation operation is not performed, an accurate tone color control (filter characteristics control) may be realized by causing multiple sets of filter coefficients to be stored in the filter coefficient memory.

As described above, according to the invention, filter coefficients are generated by interpolation so that filter coefficients can be generated densely in accordance with contents of the tone color control without increasing the amount of filter coefficients to be prepared. Accordingly, rich filter characteristics can be realized with a relatively simple circuit construction in a tone color control using a digital filter whereby a tone color change control which is rich in variety can be realized. By timewise changing the value of a control signal as an interpolation parameter, for example, filter coefficients which change smoothly with a relatively fine time interval can be generated without increasing the amount of filter coefficients to be prepared whereby a smooth timewise tone color change can be realized with a relatively simple circuit construction. In a case where the value of the control signal as interpolation parameter changes in accordance with tone color control elements such as key touch, tone pitch or tone range, manual operator output, envelope shape data and low frequency modulating signal, fine filter coefficients can likewise be obtained without increasing the amount of filter coefficients to be prepared whereby a tone color change control rich in variety corresponding to the tone color control information can be realized.

Further, according to the invention, filter coefficients to be read out from filter coefficient memory means are basically designated generally by reference value data and, accordingly, contents of storage in the filter coefficient memory means can be utilized with rich variation by determining this reference data as desired so that a tone color change control rich in variety can be realized in this manner also. In other words, selection of filter coefficients can be made easily and in various manners whereby further complex digital filter characteristics control can be made in a relatively simple manner.

Further, according to the invention, coordinate data of at least two axes are assigned to each set of filter coefficients stored in memory means and coordinate data of at least one coordinate axis in coordinate data for a set of filter coefficients which has been designated to be read out is variably controlled in response to tone color control information and the set of filter coefficients corresponding to the variably controlled coordinate data is read out from the memory means. Selection of filter coefficients can therefore be made in various manners depending upon selection of the coordinate axis to be changed and variable control of the coordinate axis whereby a further complex digital filter characteristics control can be made in a relatively simple manner.

What is claimed is:

1. A tone signal processing device comprising:

digital filter means receiving an input tone signal and filter coefficients for controlling filtering of the input tone signal in accordance with characteristics determined by the filter coefficients;

filter coefficient supply means for supplying at least two sets of filter coefficients corresponding to different filter characteristics;

control signal generation means for generating a control signal for controlling tone color; and filter coefficient interpolation means for interpolating the filter coefficients supplied by said filter coefficient supply means using the control signal and supplying filter coefficients obtained by interpolation of said digital filter means.

2. A tone signal processing device as defined in claim 1 wherein at least two sets of filter coefficients supplied by said filter coefficient supply means respectively correspond to different time frames, the control signal generated by said control signal generation means changes its value as time elapses, and said filter coefficient interpolation means produces timewise changing filter coefficients by timewise changing the control signal which is used as a parameter of interpolation and thereby causes filter characteristics in said digital filter means to change timewise.

3. A tone signal processing device as defined in claim 1 wherein the control signal generated by said control signal generation means has a value corresponding to touch applied to a depressed key for designating tone pitch of the tone signal.

4. A tone signal processing device as defined in claim 1 wherein the control signal generated by said control signal generation means has a value corresponding to tone pitch or tone range of the tone signal.

5. A tone signal processing device as defined in claim 1 wherein said control signal generation means comprises envelope shape generation means and generates the control signal which has a value corresponding to envelope shape data generated by said envelope shape generation means.

6. A tone signal processing device as defined in claim 1 wherein said control signal generation means comprises means for generating a low frequency modulating signal and generates the control signal which has a value corresponding to this modulating signal.

7. A tone signal processing device as defined in claim 1 wherein said control signal generation means comprises a manually operated operator and generates the control signal which has a value corresponding to output of operation of the operator.

8. A tone signal processing device as defined in claim 1 wherein said filter coefficient interpolation means performs an interpolation operation as a function of the difference between two filter coefficients which are to be interpolated.

9. A tone signal processing device as defined in claim 1 wherein said filter coefficient interpolation means performs interpolation operation as a function of at least one of two filter coefficients to be interpolated and a prepared coefficient difference value.

10. A tone signal processing device comprising:

digital filter means receiving an input tone signal and filter coefficients for controlling filtering of the input tone signal in accordance with characteristics determined by the filter coefficients;

filter coefficient supply means for storing plural sets of plural coefficients corresponding to desired filter characteristics;

reference value data determining means for determining reference value data for designating filter coefficients to be read out from said filter coefficient memory means;

control data generation means for generating control data for variable controlling tone color;

operation means for operating said reference value data and said control data to provide filter coefficient operation data including an integer section and a decimal section;

selection means for selecting and reading from said filter coefficient memory means at least two sets of filter coefficients in accordance with the integer section of the filter coefficient operation data; and filter coefficient interpolation means for interpolating the filter coefficients read out by said selection means using the decimal section of the filter coefficient operation data as a parameter of interpolation and supplying filter coefficients obtained by interpolation to said digital filter means.

11. A tone signal processing device as defined in claim 10 wherein said control data is numerical data containing a decimal section and said operation means performs at least one of the arithmetic operations of addition, subtraction, multiplication and division.

12. A tone signal processing device comprising:

digital filter means receiving an input tone signal and filter coefficients for controlling filtering of the input tone signal in accordance with characteristics determined by the filter coefficients;

coefficient memory means for storing plural sets of filter coefficients corresponding to desired filter characteristics, each of said plural sets being assigned with coordinate data of at least two axes;

coordinate designation means for designating coordinate data of a coefficient set to be read out from said coefficient memory means; and control means for variably controlling coordinate data of at least one coordinate axis in the coordinate data designated by said coordinate designation means in accordance with tone color information;

filter coefficient set being read out from said coefficient memory means in response to coordinate data established in accordance with the designation by said coordinate designation means and the variable control by said control means and the read out filter coefficient set being supplied to said digital filter means.

13. A tone signal processing device as defined in claim 12 wherein a coordinate axis to be variably controlled is selectable in said control means and coordinate data for the selected coordinate axis in coordinate data designated by said coordinate designation means is variably controlled in accordance with the tone color control information.

14. A tone signal processing device comprising:

coefficient supply means for supplying at least two sets of coefficients corresponding to different filter characteristics;

control signal generation means for generating a control signal;

filter coefficient generating means for receiving said at least two sets of coefficients and said control signal and for generating a filter coefficient obtained by performing a certain operation on said at least two sets of coefficients in accordance with said control signal; and digital filter means receiving a tone signal for modifying the received tone signal in accordance with said filter coefficient, so that a characteristic determined by said filter coefficient is imparted to said tone signal.

15. A tone signal processing device as defined in claim 14 wherein said control signal has a value changing with a lapse of time so that said characteristic to be imparted to said tone signal changes with a lapse of time.

16. A tone signal processing device as defined in claim 14 which further comprises keyboard means having a plurality of keys and wherein said control signal has a value corresponding to touch applied to a depressed key among said plurality of keys, so that said characteristic to be imparted to said tone signal is responsive to said touch.

17. A tone signal processing device as defined in claim 14 wherein said tone signal has a tone pitch and said control signal has a value corresponding to said tone pitch or a tone range to which said tone pitch belongs, so that said characteristic to be imparted to said tone signal is responsive to said tone pitch or said tone range.

18. A tone signal processing device as defined in claim 14 wherein said control signal generation means comprises envelope shape generation means for generating an envelope shape to be imparted to said tone signal, said control signal having a value corresponding to said envelope shape.

19. A tone signal processing device as defined in claim 14 wherein said control signal generation means comprises a low frequency, so that said filter coefficient having low-frequency is modulated in accordance with said control signal.

20. A tone signal processing device as defined in claim 14 wherein said control signal generation means comprises a manually-operable operator element, said control signal having a value responsive to operation of said operator element.

21. A tone signal processing device as defined in claim 14 wherein said filter coefficient generating means comprises interpolation operation means for performing interpolation operation of said at least two filter coefficients as said certain operation.

22. A tone signal processing device as defined in claim 21 wherein said interpolation operation means performs said interpolation operation on the basis of one of said at least two sets of coefficients and a prepared difference value between said at least two sets of coefficients.

23. A tone signal processing device as defined in claim 14 wherein said control signal has a constant value.

24. A tone signal processing device as defined in claim 14 wherein said at least two sets of coefficients correspond to different time frames, so that said characteristic to be imparted to said tone signal changes in accordance with said time frames.

25. A tone signal processing device comprising:

coefficient supply means for storing plural sets of coefficients corresponding to different filter characteristics;

reference value data designating means for designating reference value data which determine a manner in which at least two sets of said plural sets of coefficients are to be mixed;

filter coefficient generating means for receiving said at least tow sets and for generating a filter coefficient based on said at least two sets in accordance with said manner; and digital filter means receiving a tone signal for modifying the tone signal in accordance with said filter coefficient, so that a characteristic determined by said filter coefficient is imparted to said tone signal.

26. A tone signal processing device as defined in claim 25 wherein said reference value data is divided in to an integer section and a decimal section, said integer section determining said manner.

27. A tone signal processing device comprising:

coefficient memory means for storing plural sets of coefficients corresponding to different filter characteristics, each of said plural sets being assigned to at least two coordinate axes;

coordinate designation means for designating coordinate data representing said coordinate axes;

filter coefficient generating means for receiving said coordinate data for generating a filter coefficient based on the plural sets of coefficients assigned to the coordinate axis designated by said coordinate data; and digital filter means receiving a tone signal and said filter coefficient for modifying the tone signal in accordance with said filter coefficient, so that a characteristic determined by said filter coefficient is imparted to said tone signal.

28. A tone signal processing device as defined in claim 27 wherein one of said at least two axes corresponds to tone color to be imparted to said tone signal.

* * * * *